US011354978B2

(12) United States Patent
O'Hara et al.

(10) Patent No.: US 11,354,978 B2
(45) Date of Patent: Jun. 7, 2022

(54) PROGRESSIVE GAMING SYSTEM WITH VARIABLE ESCROW CONTRIBUTION OR APPLICATION

(71) Applicant: Aristocrat Technologies, Inc., Las Vegas, NV (US)

(72) Inventors: Jeremiah O'Hara, Las Vegas, NV (US); James King, Las Vegas, NV (US); Rena M. Schoonmaker, Las Vegas, NV (US); Craig Paulsen, Reno, NV (US); Nash Jaffer, Las Vegas, NV (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 180 days.

(21) Appl. No.: 16/826,124

(22) Filed: Mar. 20, 2020

(65) Prior Publication Data

US 2021/0295652 A1 Sep. 23, 2021

(51) Int. Cl.
*G07F 17/32* (2006.01)

(52) U.S. Cl.
CPC ..... *G07F 17/3258* (2013.01); *G07F 17/3262* (2013.01); *G07F 17/3288* (2013.01)

(58) Field of Classification Search
CPC ..... G07F 17/3228; G07F 17/3262; G07F 17/3288
See application file for complete search history.

(56) References Cited

U.S. PATENT DOCUMENTS

| | | | |
|---|---|---|---|
| 6,032,955 | A | 3/2000 | Luciano et al. |
| 6,224,484 | B1 | 5/2001 | Okuda et al. |
| 6,776,715 | B2 | 8/2004 | Price |
| 7,753,784 | B2 | 7/2010 | Baerlocher |
| 7,771,276 | B2 | 8/2010 | Beatty et al. |
| 7,862,427 | B2 | 1/2011 | Nguyen et al. |
| 8,070,605 | B2 | 12/2011 | Tien et al. |
| 8,147,320 | B2 | 4/2012 | Englman et al. |
| 8,221,228 | B2 | 7/2012 | Anderson |
| 8,257,167 | B2 | 9/2012 | Fujimori et al. |

(Continued)

OTHER PUBLICATIONS

"IGT—New Concept MS Legends Pairs Games With Their Own SAP for Jackpot Shoppers," IGT, ClubIQ, Nov. 8, 2019, 4 pages.

(Continued)

*Primary Examiner* — Corbett B Coburn
(74) *Attorney, Agent, or Firm* — Armstrong Teasdale LLP

(57) ABSTRACT

Innovations in game design features of an electronic gaming device are presented. A progressive jackpot is associated with an escrow. At least a portion of the escrow can be applied to a reset amount for the progressive jackpot. The amount of escrow applied to the reset amount can vary, such as based on a current escrow value. The progressive jackpot can be associated with an increment rate and an escrow rate. The increment rate or the escrow rate may vary based on one or more parameters, including one or more game parameters. Game parameters can include game output parameters, such as a coin out amount, a number of games played, a handpay amount, or a number of players actively engaged in game play with a particular progressive jackpot. Changes in how escrow is applied, or how increment or escrow rates are determined, can be based on time periods or events.

20 Claims, 12 Drawing Sheets

(56) References Cited

U.S. PATENT DOCUMENTS

| | | | |
|---|---|---|---|
| 8,323,101 | B2 | 12/2012 | Anderson et al. |
| 8,342,956 | B2 | 1/2013 | Anderson |
| 8,348,755 | B2 | 1/2013 | Kelly et al. |
| 8,353,761 | B2 | 1/2013 | Kelly et al. |
| 8,360,869 | B2 | 1/2013 | Kelly et al. |
| 8,382,586 | B2 | 2/2013 | Kelly et al. |
| 8,414,389 | B2 | 4/2013 | Cahill et al. |
| 8,449,387 | B2 | 5/2013 | Englman et al. |
| 8,460,086 | B2 | 6/2013 | Joshi et al. |
| 8,535,147 | B2 | 9/2013 | Ward |
| 8,545,308 | B2 | 10/2013 | Walker |
| 8,585,494 | B2 | 11/2013 | Parrinello et al. |
| 8,622,813 | B2 | 1/2014 | Okada |
| 8,651,946 | B1 | 2/2014 | Doyle |
| 8,715,071 | B2 | 5/2014 | Keenan et al. |
| 8,740,710 | B2 | 6/2014 | Kelly et al. |
| 8,753,196 | B2 | 6/2014 | Baerlocher |
| 9,039,522 | B2 | 5/2015 | Guan et al. |
| 9,053,602 | B2 | 6/2015 | Michaelson et al. |
| 9,189,921 | B2 | 11/2015 | Spencer et al. |
| 9,230,402 | B2 | 1/2016 | Green et al. |
| 9,311,779 | B2 | 4/2016 | Kelly et al. |
| 9,342,956 | B2 | 5/2016 | Hughes |
| 9,355,521 | B2 | 5/2016 | King |
| 9,378,608 | B2 | 6/2016 | Enzminger et al. |
| 9,430,904 | B2 | 8/2016 | Larsen |
| 9,520,029 | B2 | 12/2016 | Guinn |
| 9,672,694 | B2 | 6/2017 | Lowell et al. |
| 9,741,209 | B2 | 8/2017 | Aoki |
| 9,824,531 | B2 | 11/2017 | Iyer et al. |
| 9,830,777 | B2 | 11/2017 | Yoseloff et al. |
| 10,002,494 | B2 | 6/2018 | Saffari et al. |
| 10,008,072 | B2 | 6/2018 | Czyzewski et al. |
| 10,026,269 | B2 | 7/2018 | Upton et al. |
| 10,204,485 | B2 | 2/2019 | Korthauer et al. |
| 10,210,707 | B2 | 2/2019 | Suda et al. |
| 10,210,710 | B2 | 2/2019 | Lyons et al. |
| 10,373,435 | B2 | 8/2019 | Yoseloff et al. |
| 2002/0190471 | A1 | 12/2002 | Vancura et al. |
| 2005/0239542 | A1 | 10/2005 | Olsen |
| 2006/0142079 | A1* | 6/2006 | Ikehara ..... G07F 17/32 463/27 |
| 2006/0154718 | A1* | 7/2006 | Willyard ..... G07F 17/3258 463/25 |
| 2007/0191088 | A1 | 8/2007 | Breckner |
| 2011/0195773 | A1 | 8/2011 | Michaelson et al. |
| 2012/0108324 | A1 | 5/2012 | King |
| 2013/0084950 | A1 | 4/2013 | Olsen |
| 2013/0252723 | A1 | 9/2013 | Nicely et al. |
| 2014/0213348 | A1 | 7/2014 | Vasquez et al. |
| 2016/0217657 | A1 | 7/2016 | Halter et al. |
| 2016/0314657 | A1 | 10/2016 | Buchholz et al. |
| 2017/0024968 | A1 | 1/2017 | Saffari et al. |
| 2017/0221309 | A1 | 8/2017 | Hughes et al. |
| 2018/0005490 | A1 | 1/2018 | Reddicks et al. |
| 2018/0082531 | A1 | 3/2018 | Yoseloff et al. |
| 2018/0082533 | A1 | 3/2018 | Hallerbach et al. |
| 2018/0225924 | A1 | 8/2018 | Cohen et al. |

OTHER PUBLICATIONS

Office Action dated Aug. 19, 2021 for U.S. Appl. No. 16/940,104 (pp. 1-15).

Office Action (Final Rejection) dated Feb. 7, 2022 for U.S. Appl. No. 16/940,104 (pp. 1-17).

* cited by examiner

712

| Coin Out | Increment% | Escrow% |
|---|---|---|
| <$10,000 | 4% | 0% |
| <$20,000 | 3% | 1% |
| <$30,000 | 2% | 2% |
| >=$30,000 | 1% | 3% |

714 710 716

762

| Games Played | Increment% | Escrow% |
|---|---|---|
| <100 | 4% | 0% |
| <200 | 3% | 1% |
| <300 | 2% | 2% |
| <400 | 1% | 3% |
| >=400 | 0.5% | 3.5% |

764 760 766

1200

| Escrow Amount | Escrow Applied | Jackpot Value | Remaining Escrow |
|---|---|---|---|
| >=$8,000 | 100% | $18,000 | $0 |
| <=$10,000 | 75% | $17,500 | $2,500 |
| <=$15,000 | 50% | $17,500 | $7,500 |
| >=$25,000 | 80% | $30,000 | $5,000 |

1210 1214 1218 1222 1210a 1210b 1210c 1210d

1300

```
Do {
Escrow applied = Escrow amount * 0.05 ParameterA + Escrow amount * 0.25
New escrow amount = Escrow amount – Escrow applied
Escrow amount = New escrow amount
} IF (new escrow amount >= 0)
```

PROGRESSIVE GAMING SYSTEM WITH VARIABLE ESCROW CONTRIBUTION OR APPLICATION

TECHNICAL FIELD

The present disclosure generally relates to electronic gaming. Particular embodiments provide systems and methods for determining how portions of a progressive contribution (e.g., in response to game play on an electronic gaming machine) are allocated to a progressive jackpot value or to escrow, or to how escrow is applied to a progressive jackpot value.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

Many EGMs include jackpots, which typically are infrequently occurring, relatively high value awards. Some jackpots have fixed values, while other jackpots can have values that increase, which can be referred to as progressive jackpots. For example, a portion of wagers placed on an EGM may be allocated to the progressive jackpot. Progressive jackpots can be linked to game play on multiple EGMs, which can be referred to as linked progressive jackpots. In many cases, a separate progressive system server is used to manage linked progressive jackpots. Individual EGMs can be connected to the progressive system server.

Progressive jackpots can optionally be configured to have minimum or maximum values. When a progressive jackpot is awarded, the value of the progressive jackpot typically is changed to a lower amount, which can be referred to as a reset amount.

An EGM can be associated with multiple jackpots, which can be awarded based on different RNG outcomes, and can be configured differently. For example, an EGM may be configured to accept wagers in discrete amounts or ranges, where each amount or range is designated as a certain level or tier. Some jackpots may only be associated with a subset of the levels. For example, a minimum wager amount may be required before a given jackpot is made available as potential game outcome.

Multiple jackpots associated with an EGM can be hierarchically arranged in levels or tiers, typically by value or by maximum value in the case of progressive jackpots. Often, the different tiers or levels are set such that a jackpot of a lower value tier will not be permitted to have a higher actual value than a jackpot of a higher level tier. For example, consider a progressive jackpot system that includes a first jackpot level having a minimum value of $50 and a maximum value of $500, and a second jackpot level having a minimum value of $500 and a maximum value of $5,000. In this case, the first level jackpot will never have a value that is higher than the second level jackpot.

Providing different levels of jackpots can increase player excitement and otherwise enhance game play experience by having a larger number of awards available, and at different stages (e.g., values compared with a maximum value or a reset value). When different jackpot levels are associated with different wager levels, a user may have more flexibility in game play, such as being able to switch back and forth between higher and lower wager levels depending on when they think a given EGM is ready to "hit," including at a particular jackpot level. However, typical progressive jackpots are limited in how jackpot awards are managed. Accordingly, room for improvement exists.

SUMMARY

In one aspect, an electronic gaming system is provided that includes an electronic gaming machine configured to present a wagering game. A progressive system server is in communication with the electronic gaming machine. For a plurality of game instances played in association with the progressive system server, the progressive system server can track one or more game output parameters.

Based on the tracking, a first value is determined of at least a first game output parameter of the one or more game output parameters. The first value is compared with a first threshold defined for the at least a first game output parameter. It is determined that the first value does not satisfy the first threshold.

Based at least in part on determining that the first value does not satisfy the first threshold, a first portion of a first progressive contribution of a first game of the plurality of games is allocated at a first percentage to a progressive jackpot value associated with the progressive system server.

A second portion of the first progressive contribution is allocated to an escrow amount at a second percentage. The first and second percentages can be the same, and the second percentage can be zero.

Based on the tracking, a second value is determined for at least a second game output parameter. The at least a second game output parameter can be the at least a first game output parameter. The second value is greater than the first value when the at least a second game output parameter is the at least a first game output parameter.

The second value is compared with a threshold defined for the at least a second game output parameter. The second threshold can be the first threshold. It is determined that the second value satisfies the second threshold.

Based at least in part on determining that the second value satisfies the second threshold, a third portion of a second progressive contribution of a second game of the plurality of games is allocated at a third percentage to the progressive jackpot value. A fourth portion of the second progressive contribution is allocated at a fourth percentage to the escrow amount. The third percentage is less than the first percentage. The fourth percentage is greater than the second percentage.

In a further aspect, the present disclosure provides a method for allocating portions of progressive contributions for game play on one or more electronic gaming machines to a progressive jackpot value and to an escrow. For a plurality of game instances, one or more game output parameters are tracked.

Based on the tracking, a first value is determined of at least a first game output parameter of the one or more game output parameters. The first value is compared with a first threshold defined for the at least a first game output parameter. It is determined that the first value does not satisfy the first threshold.

Based at least in part on determining that the first value does not satisfy the first threshold, a first portion of a first progressive contribution of a first game instance of the plurality of game instances is allocated at a first percentage to a progressive jackpot value of a progressive jackpot. A second portion of the first progressive contribution is allocated to an escrow amount at a second percentage. The first and second percentages can be the same, and the second percentage can be zero.

Based on the tracking, a second value is determined for at least a second game output parameter. The at least a second game output parameter can be the at least a first game output parameter. The second value is greater than the first value when the at least a second game output parameter is the at least a first game output parameter.

The second value is compared with a threshold defined for the at least a second game output parameter. The second threshold can be the first threshold. It is determined that the second value satisfies the second threshold.

Based at least in part on determining that the second value satisfies the second threshold, a third portion of a second progressive contribution of a second game instance of the plurality of game instances is allocated at a third percentage to the progressive jackpot value. A fourth portion of the second progressive contribution is allocated at a fourth percentage to the escrow amount. The third percentage is less than the first percentage. The fourth percentage is greater than the second percentage.

In a further aspect, one or more computer readable storage media are provided that store instructions that, when executed by a computing device, cause the computing device to perform operations for allocating portions of progressive contributions for game play on one or more electronic gaming machines to a progressive jackpot value or to an escrow. For a plurality of game instances, one or more game output parameters are tracked.

Based on the tracking, a first value is determined of at least a first game output parameter of the one or more game output parameters. The first value is compared with a first threshold defined for the at least a first game output parameter. It is determined that the first value does not satisfy the first threshold.

Based at least in part on determining that the first value does not satisfy the first threshold, a first portion of a first progressive contribution of a first game instance of the plurality of game instances is allocated at a first percentage to a progressive jackpot value of a progressive jackpot. A second portion of the first progressive contribution is allocated to an escrow amount at a second percentage. The first and second percentages can be the same, and the second percentage can be zero.

Based on the tracking, a second value is determined for at least a second game output parameter. The at least a second game output parameter can be the at least a first game output parameter. The second value is greater than the first value when the at least a second game output parameter is the at least a first game output parameter.

The second value is compared with a threshold defined for the at least a second game output parameter. The second threshold can be the first threshold. It is determined that the second value satisfies the second threshold.

Based at least in part on determining that the second value satisfies the second threshold, a third portion of a second progressive contribution of a second game instance of the plurality of game instances is allocated at a third percentage to the progressive jackpot. A fourth portion of the second progressive contribution is allocated at a fourth percentage to the escrow amount. The third percentage is less than the first percentage. The fourth percentage is greater than the second percentage.

Disclosed innovations can be implemented as part of a method, as part of an electronic gaming device such as an EGM or electronic gaming server configured to perform the method, or as part of non-transitory computer-readable media storing computer-executable instructions for causing one or more processors in a computer system to perform the method. The various innovations can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the invention will become more apparent from the following detailed description, which proceeds with reference to the accompanying figures and illustrates a number of examples. Examples may also be capable of other and different applications, and some details may be modified in various respects all without departing from the spirit and scope of the disclosed innovations.

DETAILED DESCRIPTION

Overview

Figure 1:
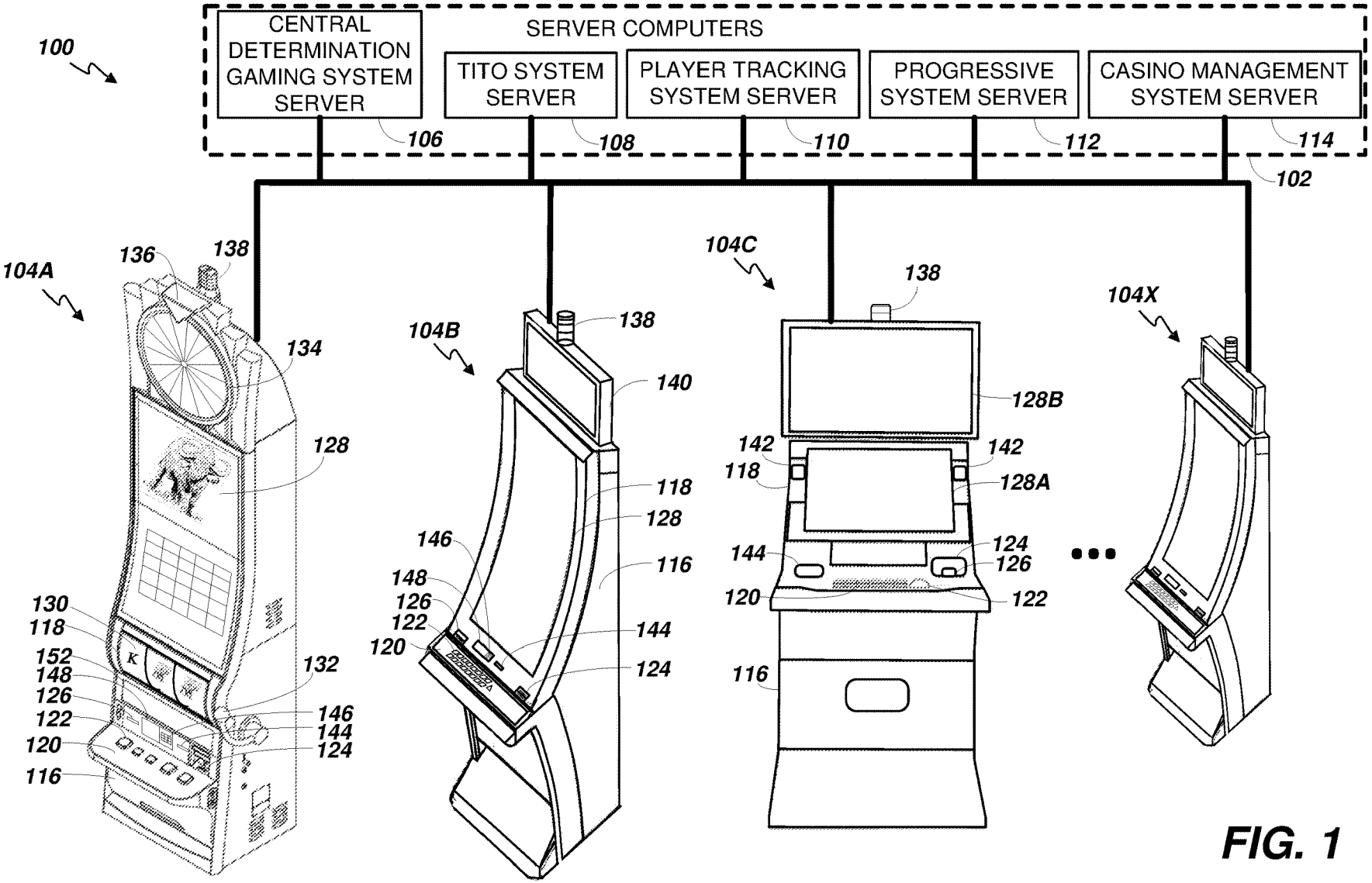
FIG. 1 is an exemplary diagram showing several EGMs networked with various gaming related servers.

As discussed above, typical progressive jackpot systems have limited ways of determining progressive jackpot amounts, including determining when and how such amounts should be incremented. Typically, progressive jackpot increment rates are fixed, or are tied to a limited set of features, such as a current jackpot value. Thus, the ability of game designers to provide different game play experiences is limited. The disclosed technologies can address these and other problems by providing improved methods of setting and updating progressive jackpot amounts.

Disclosed embodiments include a progressive jackpot system that includes a progressive system, which can be a linked progressive system that is in communication with multiple EGMs. The progressive system can be associated with an increment rate—a rate at which a portion (such as a percentage) of a progressive contribution, such as an amount corresponding to a portion of a wager placed on an EGM associated with the progressive system, is allocated to a progressive jackpot. In other cases, the progressive can be independent of a wager amount for game play associated with the progressive contribution. The increment rate can be variable. For example, the rate can be 2% under a first set of conditions and 4% under another set of conditions.

The progressive system can also be associated with an escrow. In a similar manner as how a portion of a progressive contribution can be allocated to a progressive jackpot value based on an increment rate, a portion of a progressive contribution can be allocated to the escrow based on an escrow rate. The escrow rate can be variable.

Values assigned to an increment rate and an escrow rate can be interdependent. For example, a total progressive contribution rate may be set, and a portion of the total progressive contribution rate allocated as the increment rate and a remaining portion being allocated as the escrow rate. As an example, if the total progressive contribution rate is 4%, the increment rate and escrow rate could each be 2%. Or, the increment rate could be 1% and the escrow rate could be 3%. In at least some cases, the total progressive contribution rate is fixed, but the amount allocated to the increment rate or to the escrow rate can vary.

In one aspect, the present disclosure provides additional parameters that can be used to determine one or both of an increment rate or an escrow rate. While typical progressive systems with variable increment rates use game input parameters, such as a current progressive jackpot value or coin in (total wagers received by an EGM or multiple EGMs in a linked progressive system), disclosed technologies can use game output parameters. Game output parameters can include values such as a coin out amount (total amount paid out by an EGM or a set of EGMs), a hand payout amount (awards paid by an attendant rather than by the EGM, where hand payout amounts are typically larger awards), a number of games played, a number of EGMs connected to a linked progressive system, or a number of games in a linked progressive system that are actively being played by players. In some cases, multiple output parameters can be used. Or, one or more game output parameters can be used in conjunction with one or more game input parameters, or other game parameters, in order to determine one or both of an increment rate or an escrow rate. Game parameters can also be provided with respect to a time period, such as using coin in/unit time coin-out/unit time (e.g., coin out per day, per hour, etc.), which can be referred to as a parameter velocity.

In some cases, setting of increment or escrow rates can be determined using one or more thresholds. However, setting of these rates can also occur using more complicated logic conditions, including based on evaluating current values of two or more parameters using different criteria. In other cases, more flexible ways of setting an increment rate or an escrow rate can be used, such as using a function that takes as input values for one or more parameters.

The present disclosure also includes technologies that facilitate a user, or process, in setting progressive jackpot values or increment/escrow rates. For example, it may be that certain values for a progressive jackpot are more likely to generate player interest than others. If a current progressive jackpot value is relatively low, including compared to its maximum amount or compared with a reset amount, players may be less excited about game play that might have that jackpot as an outcome. The reduced interest can be because the progressive jackpot is less valuable, but also can be because the player may assume that the EGM is less likely to "hit" that jackpot. Accordingly, disclosed technologies assist in setting progressive jackpot levels to facilitate reaching a "sweet spot" associated with increased player interest, and increasing the time the progressive jackpot stays near or above that level before being awarded.

In addition to adjusting the increment or escrow rates to improve the setting of jackpot award amounts (e.g., having a higher percentage of a progressive contribution allocated to the increment until the sweet spot is reached and then changing rates so that a higher percentage of a progressive contribution is allocated to escrow), the present disclosure provides technologies for using an escrow to improve how progressive jackpot values are determined or funded. For example, an amount of escrow can be included in a reset amount to get the progressive jackpot's value closer to the level of the sweet spot.

According to other aspects of the present disclosure, escrow can be applied to one or more progressive jackpot values upon additional types of triggering events, including events that do not relate to game play on EGMs associated with the progressive jackpot. For example, an amount from escrow can be added to a progressive jackpot upon the occurrence of an event, such as a sports team winning a game, a concert or show finishing at or proximate a location associated with an EGM, or a holiday. In some cases, the escrow amount is permanently added to a progressive jackpot upon the occurrence of an event. In other cases, the progressive jackpot may be temporarily increased. If the progressive jackpot is not awarded during a period of time (e.g., the ending of the specified event or within a particular time after the ending of the specified event or the initial trigger), the amount of the progressive jackpot corresponding to the amount transferred from escrow is returned to escrow. Having the ability to increase progressive jackpot values in association with special events can further increase player excitement and satisfaction.

In a similar manner, increment or escrow rates can be changed based on non-game play triggers, including special events. Other types of non-game play triggers can include triggers based on particular time periods, such as having different rates for different times of day, days of the week, holiday versus non-holidays periods, seasons, etc.

Escrow amounts can sometimes be used to increase a progressive jackpot value instead of, or in addition to, increases due to new wagers using the increment rate. For example, even if no players are actively playing EGMs associated with a progressive jackpot, it may be desirable to increase the progressive jackpot's value. Amounts can be transferred from escrow to the progressive jackpot value in the absence of new player wagers, or can be used to supplement increases due to player wagers.

In some cases, the increment and escrow rates can be adjusted to help provide a desired growth rate for a progressive jackpot, including in the absence of sufficient game play activity to provide the growth rate using contributions associated with game play. The increment rate can be decreased, and the escrow rate can be increased during periods of relatively high game play activity, at least until a desired escrow level is reached, so that escrow is available to fund jackpot increases during periods of lower game play activity. During lower periods of game play activity, the increment rate can be increased, and the escrow rate can be decreased so that a larger portion of a progressive contribution helps fund progressive jackpots, along with optionally supplementing jackpot increases with amounts from escrow. Periods of low/high game play activity can be determined dynamically in some cases, and can be used to adjust the escrow rate and the increment rate on the fly, or to adjust an amount/rate of escrow used to supplement progressive jackpot increases. In other cases, these periods can be determined in other ways and particular rates can be tied with particular time periods, days of the week, seasons, etc.

In some cases, a constant rate of increase in progressive jackpot value may become boring to players. Accordingly, disclosed technologies, including ways of adjusting increment rates, escrow rates, and rates at which escrow is applied to increase a progressive jackpot, can be used to provide variability in the rate at which a progressive jackpot increases. This variability can increase player excitement, particularly in periods where the rate the progressive jackpot value increases is relatively high.

Example Electronic Gaming Servers and Electronic Gaming Machines

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links, and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. In some cases, the progressive system server 112 is physically separate from a gaming device 104A-104X, and can be in communication with a gaming device, such as over a network. In other cases, the progressive system server 112 can be a component (including a software component or module) of a gaming device 104A-104X, and can be in communication with other components of a gaming device, such as logic or hardware used to determine other (e.g., non-progressive jackpot) game outcomes). Typically, in linked progressive systems, the progressive system server 112 is physically separate from at least one, and typically from all, gaming devices 104A-104X that participate in an associated progressive jackpot.

Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
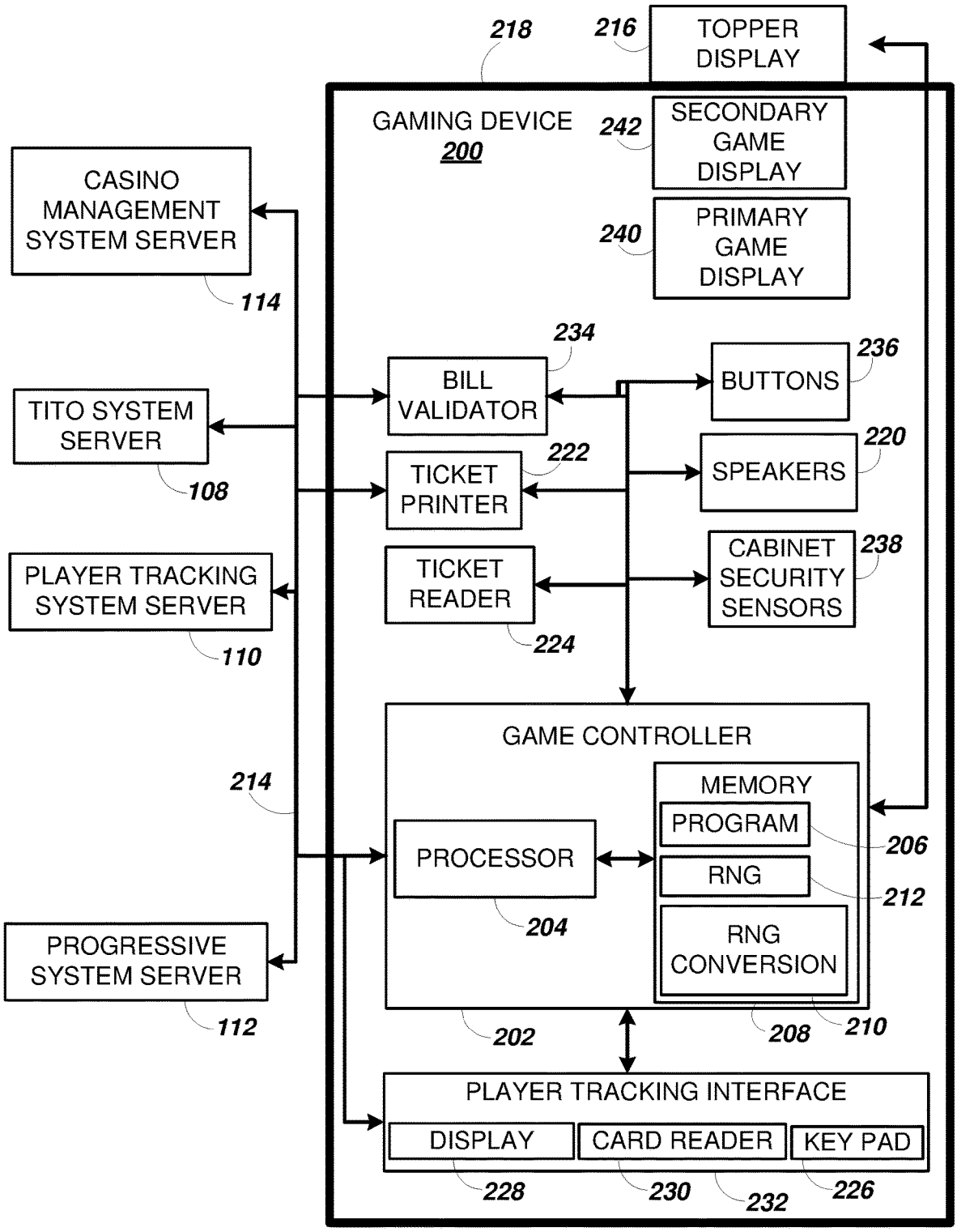
FIG. 2 is a block diagram showing various functional elements of an exemplary EGM.

Many or all the above described components can be controlled by circuitry (e.g., a game controller) housed inside the main cabinet 116 of the gaming device 104A, the details of which are shown in FIG. 2.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video blackjack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. As shown in FIG. 2, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2 illustrates that game controller 202 includes a single processor 204, game controller 202 is not limited to this representation and instead can include multiple processors 204 (e.g., two or more processors).

FIG. 2 illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2 illustrates that game controller 202 includes a single memory 208, game controller 208 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be setup to generate one or more game instances based on instructions and/or data that gaming device 200 exchange with one or more remote gaming devices, such as a central determination gaming system server 106 (not shown in FIG. 2 but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more embodiments, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP.

In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts. Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2 illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2 also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming device. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done with game play on an EGM, he/she cashes out the credit balance, typically by pressing a cash out button to receive a ticket from the ticket printer 222. The ticket may be "cashed-in" for money or inserted into another machine to establish a credit balance for play.

Although FIGS. 1 and 2 illustrates specific embodiments of a gaming device (e.g., gaming devices 104A-104X and 200), the disclosure is not limited to those embodiments shown in FIGS. 1 and 2. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or tabletops and have displays that face upwards.

Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface). Gaming devices 104A-104X and 200 may also include other processors that are not separately shown. Using FIG. 2 as an example, gaming device 200 could include display controllers (not shown in FIG. 2) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 3:
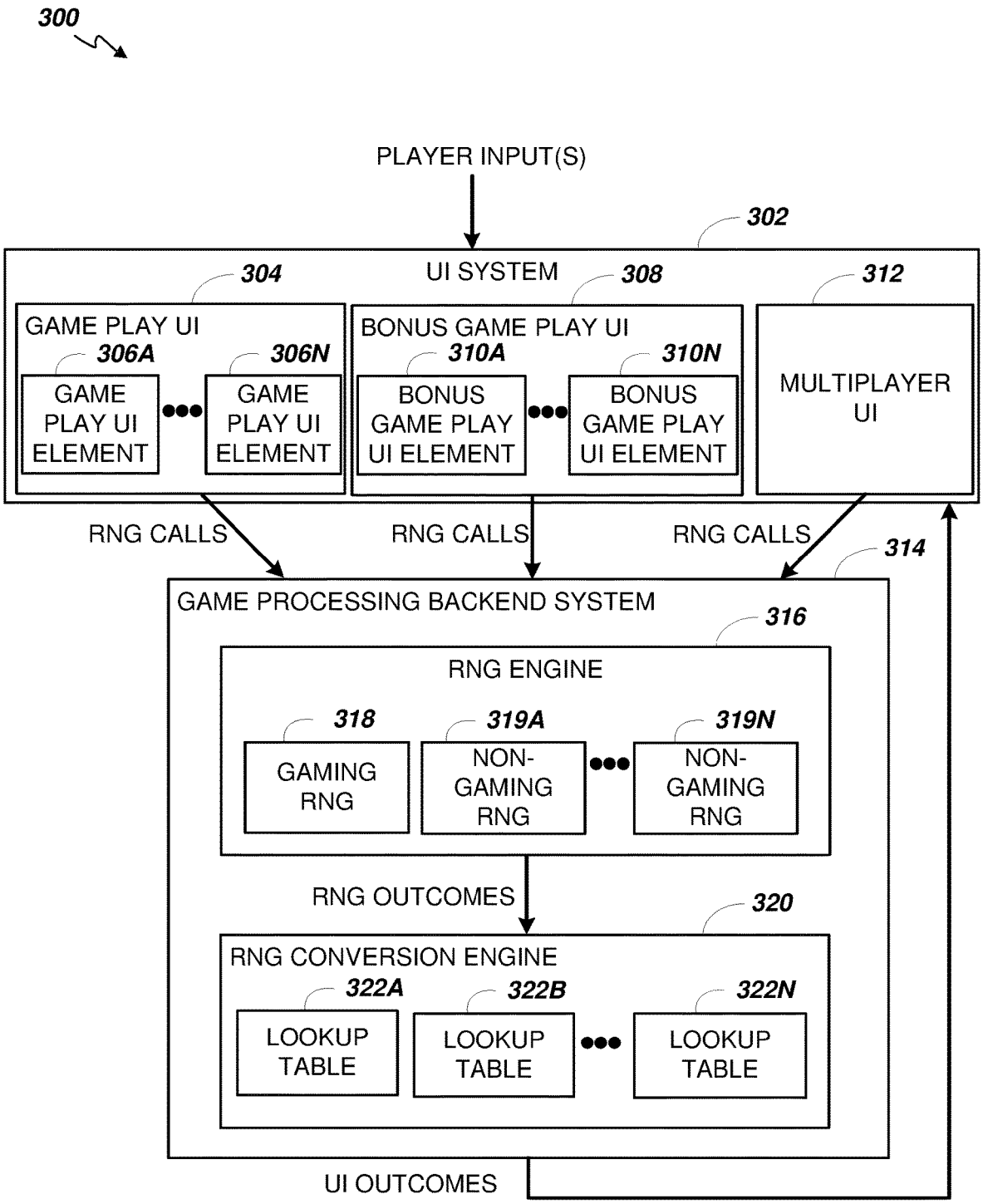
FIG. 3 illustrates, in block diagram form, an embodiment of a game processing architecture algorithm that implements a game processing pipeline for the play of a game in accordance with various embodiments described herein.

FIG. 3 illustrates, in block diagram form, an embodiment of a game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical UIs and/or graphical UIs (GUIs). In other words, game play UI 304, bonus game play UI 308, and the multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from the bonus game play UI elements 310A-310N.

FIG. 3 also illustrates that UI system 302 could include a multiplayer UI 312 purposed for game play that differ or is separate from the typical base game. For example, multiplayer UI 312 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator (PRNG) (e.g., Fortuna PRNG) that securely produces random numbers for one or more game features. To generate random numbers, gaming RNG 318 could collect random data from various sources of entropy, such as from an operating system (OS). Alternatively, non-gaming RNGs 319A-319N may not be cryptographically secure and/or be computationally less expensive. Non-gaming RNGS 319A-319N can, thus, be used to generate outcomes for non-gaming purposes. As an example, non-gaming RNGs 319A-319N can generate random numbers for such as generating random messages that appear on the gaming device.

The RNG conversion engine 320 processes each RNG outcome from RNG engine 316 and converts the RNG outcome to a UI outcome that is feedback to the UI system 302. With additional reference to FIG. 2, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome and the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops fora mechanical reel. In one example, if the UI outcome is fora base game, the UI system 302 updates one or more game play UI elements 306A-306N, such as symbols, for the game play UI 304. In another example, if the UI outcome is for a bonus game, the UI system 302 could update one or more bonus game play UI elements 310A-310N (e.g., symbols) for the bonus game play UI 308. In response to updating the appropriate UI, the player may subsequently provide additional player inputs to initiate a subsequent game instance that progresses through the game processing pipeline.

In some cases, in response to selecting a game play UI element 306A-306N or a bonus game play UI element 310A-310N, an RNG calls the RNG engine 316 and the gaming RNG 318 provides a result from a lookup table 322A-322N that indicates that a progressive jackpot is awarded. That is, the game processing backend system 314 can act as a progressive system server. In other cases, at least some of the operations described as performed by the game processing backend system 314 can be performed by another component of the EGM that provides progressive system server functionality.

The game processing backend system 314, can then send a UI outcome to the UI system 302 that renders the game outcome to display to a player. If the progressive jackpot that was awarded is a progressive jackpot, the game processing backend system 314, or another component of an EGM having the game processing backend system, can carry out aspects of the disclosed technologies, such as determining a reset amount, which can include a base reset amount and optionally an amount from escrow. If the reset amount includes an amount from escrow, the escrow amount can be updated accordingly. The game processing backend system 314, or other component, can also determine whether an increment rate or an escrow rate should be adjusted, such as part of a reset process, on the occurrence of a time or event, using a function, or upon the satisfaction of conditions involving one or more game parameters.

In cases where the jackpot is a linked progressive jackpot, at least a portion of the above described actions can be performed by a progressive server system that is in communication with the game processing backend system 314. For example, referring briefly back to FIG. 2, the processor 204 can communicate with the progressive system server 112 over the network 214. The progressive system server 112 can determine a game outcome award in at least some cases, at least determining whether a progressive jackpot should be awarded. That is, the game processing backend system 314 can determine a game outcome for awards other than the progressive jackpot, and the progressive system server 112 can determine an outcome for the progressive jackpot. In either case, the progressive system server 112 can carry out functions related to resetting the jackpot, including applying amounts from escrow or updating the increment rate or escrow rate, or applying escrow or updating the increment rate or escrow rate upon the occurrence of other conditions.

The progressive system server 112 can provide the game processing system 314 with information to be displayed using the UI system 302. For example, the game processing backend system 314 can generate a user interface display, or cause the UI system 302 to generate a display, that displays a game outcome for the progressive jackpot.

The progressive system server 112 can provide the game processing backend system 314 with information to be displayed using the UI system 302, regardless of whether a given game outcome results in an award of a progressive jackpot. For example, the progressive system server 112 can update jackpot amounts that are displayed on the user interface system 302.

Example Electronic Gaming Machine with Multiple Jackpots

Figure 4:
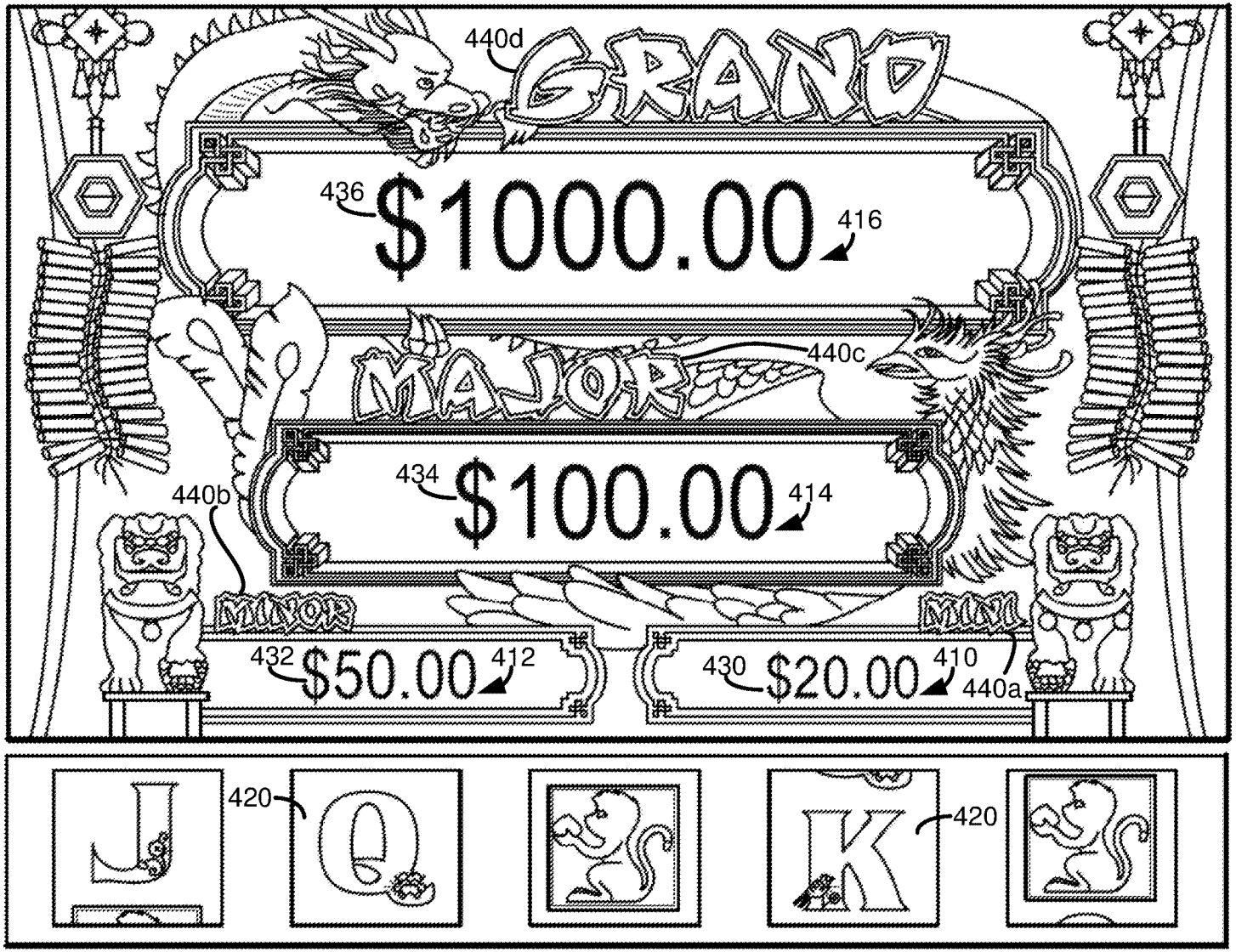
FIG. 4 is a schematic view of a display of an electronic gaming machine that includes a plurality of progressive jackpots and a plurality of reels.

FIG. 4 is a schematic view of a display 400 of an EGM (e.g., 100, 200) that includes a plurality of jackpots 410, 412, 414, 416. In some instances, one or more of jackpots 410, 412, 414, 416 can be progressive jackpots. Further, in some instances, one or more progressive jackpots can be tiered progressive jackpots. The display 400 also includes a plurality of reels 420, which can be physical (i.e. mechanical) reels or simulated reels (e.g., on a video display). The jackpots 410, 412, 414, 416 are shown as having different values, respectively values 430, 432, 434, 436. Although four jackpots are shown, a given EGM need not include any jackpots, or can include more or fewer jackpots than shown. Similarly, an EGM can have a single progressive jackpot or can have more or fewer than four progressive jackpots.

In the display 400, the jackpots 410, 412, 414, 416 can be labelled to help a player distinguish between the jackpots, such as the relative importance or value of a jackpot. As shown, labels 440*a*, 440*b*, 440*c*, 440*d* indicate that the jackpots 410, 412, 414, 416 are, respectively, a mini jackpot, a minor jackpot, a major jackpot, and a grand jackpot. The levelled nature of the jackpots 410, 412, 414, 416 is consistent with the values, 430, 432, 434, 436, as the values increase from the mini jackpot 410 to the grand jackpot 416, with a value of a "higher" level jackpot being greater than a value of any jackpot at a lower level.

As discussed, jackpots can have different types, such as being of a fixed value or being progressive jackpots. Progressive jackpots can be a stand-alone progressive (SAP) jackpot maintained with respect to a single EGM (e.g., an EGM on which the display 400 is shown), or can be a local area progressive (LAP) jackpot or wide area progressive (WAP) jackpot linked to a progressive system server that communicates with one or more additional EGMs. The jackpots 410, 412, 414, 416 can be of the same types, or can be of different types. For example, the mini jackpot 410 and the minor jackpot 412 can be stand-alone progressive jackpots, the major jackpot 414 can be part of a first linked local area progressive system, and the grand jackpot 416 can be part of a second linked wide area progressive system (typically part of a progressive system that has a larger number of participating EGMS than for the first linked progressive system). In some instances, one or more jackpots of jackpots 410, 412, 414, 416 can be fixed level jackpots.

The jackpots 410, 412, 414, 416 can be associated with different wager levels. It may be necessary for a player to make a wager at a defined or threshold value in order to have a given jackpot 410, 412, 414, 416 available as a game outcome. For example, if a player wagers a minimum amount, they may qualify for the mini jackpot 410. As the player wagers progressively more, they can qualify for higher-value jackpots 412, 414, 416. In some cases, a single jackpot 410, 412, 414, 416 is available for a given game played on the EGM. In other cases, multiple jackpots 410, 412, 414, 416 may be available as awards for a given game played on the EGM. Betting a maximum amount, for example, may qualify the player to potentially be awarded the mini jackpot 410 or the grand jackpot 416. Having multiple jackpots available can include having different jackpots 410, 412, 414, 416 associated with different aspects of a game, such as having one or more jackpots (which can be fixed or progressive) associated with a specific EGM, one or more jackpots associated with a first linked progressive system, and one or more jackpots associated with a second linked progressive system. Or, different jackpots can be available with different game play features, such as having one jackpot be associated with a base game, another jackpot being associated with a first bonus game, and another jackpot being associated with a second bonus game.

Typically, an increment rate, and, at least for some jackpots, an escrow rate, are associated with progressive jackpots that are active for a given wager. That is, for example, if jackpot 412 is the only active progressive jackpot for a given wager, a contribution will be made to the jackpot value 432 based on the increment rate and a contribution can be made to escrow based on the escrow rate, provided that the escrow rate or the increment rate may be zero (although, as mentioned, typically the sum of the increment rate and the escrow rate is set to equal a total progressive contribution rate set for the EGM). If multiple jackpots are active for a given wager, multiple contributions can be made to any of such jackpots that are progressive jackpots, where the contributions can be the same or different, and at least some of the contribution can be made on behalf of multiple jackpots (e.g., a contribution may be applied to the escrow, where the escrow can be applied to multiple jackpots, optionally including jackpots that are not active for the given wager).

Certain aspects of the present disclosure relate to adjusting an increment rate and an escrow rate. In some cases, a total progressive contribution rate is set, where the increment rate and the escrow rate can vary, but the sum of the increment rate and the escrow rate is always equal to the total progressive contribution rate. Such a constraint can help in the design of EGMs and progressive systems that comply with regulatory requirements. However, in other cases, no total progressive contribution rate exists, and so that increment rate and the escrow rate may vary as desired. Or, the total progressive contribution rate may vary, at least under, or upon the occurrence of, specified conditions.

Example Method for Managing Electronic Game Device with Progressive Jackpot

Figure 5:
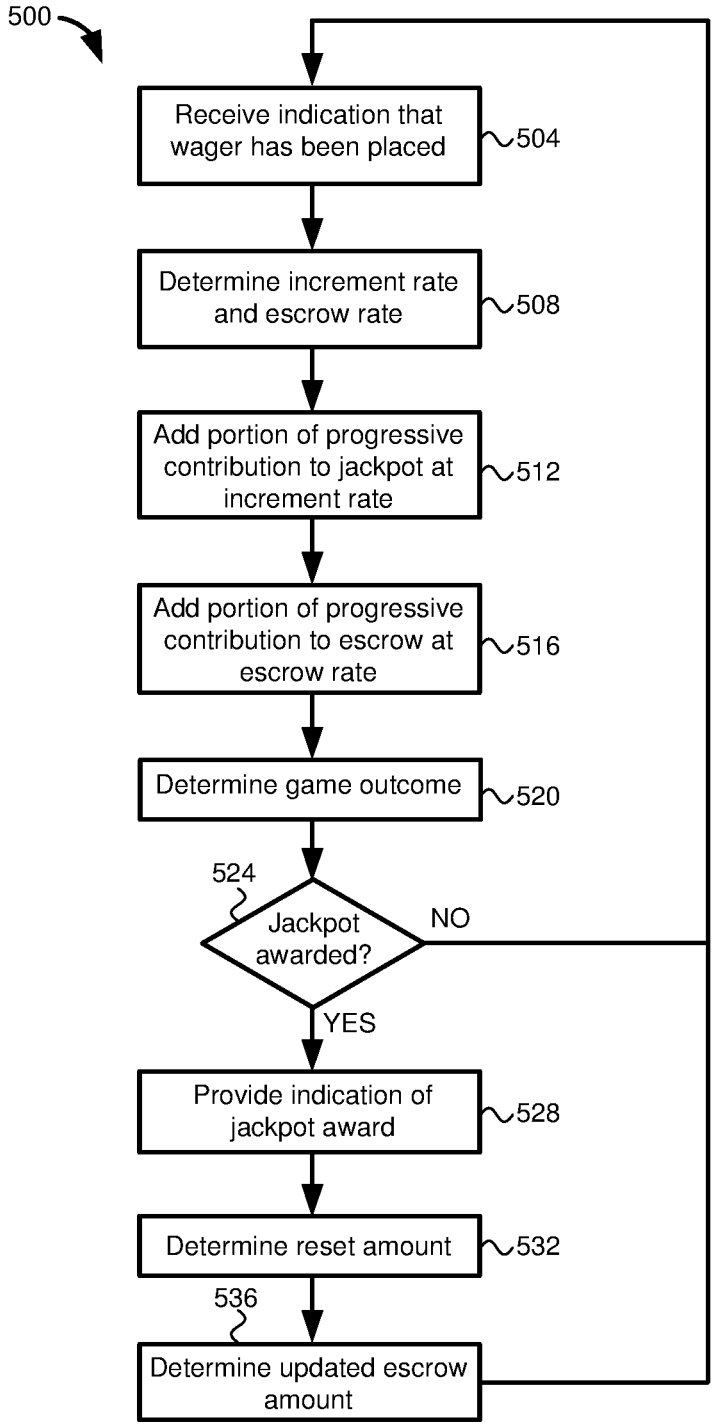
FIG. 5 is a flowchart of an example method for playing an electronic gaming machine that includes a progressive jackpot, including steps of adding a portion of a progressive contribution to a current jackpot value, adding a portion of a progressive contribution to an escrow, and determining a reset amount for the progressive jackpot when the progressive jackpot was awarded as a game outcome.

FIG. 5 is a flowchart of a method 500 of managing game play involving a progressive jackpot. In the case of a stand-alone progressive jackpot specific to a single EGM, the steps in the method 500 can be carried out by the EGM, such as using a progressive system server implemented in the game processing backend system 314 of FIG. 3, or another component of the EGM. In the case of a local or wide area progressive jackpot system that involves multiple EGMs, at least a portion of the method 500 can be performed using a progressive system server that is connected to a plurality of EGMs, such as the progressive system server 112 of FIG. 1.

A 504, the progressive system server receives an indication that a wager was placed on an EGM. In response, at 508, the progressive system server can determine an increment rate and an escrow rate. The increment and escrow rate can be determined in various manners discussed in the present disclosure. For example, the increment and escrow rates can be set based on one or more thresholds using one or more game parameters. Or, the increment and escrow rates can be set based on various rules/logical statements or using a function.

An amount is added to a progressive jackpot amount for at least one progressive jackpot at 512, using the increment rate determined at 508. The amount added to the progressive jackpot can be all or part of a progressive contribution. In some cases, the progressive contribution corresponds to a portion of a wager. For example, the increment rate can be applied to an amount corresponding to the wager for which an indication was received at 504. If the increment rate is 4%, and, the wager amount was $10, the amount added to the progressive jackpot value at 512 is $0.40. In other cases, the progressive contribution (which can be applied to a progressive jackpot value or escrow) is independent of a wager amount, such as being a fixed amount for each game instance (or at least each qualifying game instance, which may be tied to a particular wager level).

An amount is added to an escrow amount, which can be for a specific progressive jackpot or can be a pooled escrow available to multiple progressive jackpots, at 516. The amount added to escrow at 516 is based on the escrow rate, and can otherwise be calculated as explained for the increment rate at 512. Note that that one or both of the increment rate or the escrow rate may be zero, or otherwise no contribution made to the progressive jackpot value at 512 or the escrow value at 516, for particular game instances.

A game outcome is determined at 520. For example, the game controller can make a call to an RNG, and the RNG result compared with a lookup table to determine a game outcome. It is determined at 524 whether a progressive jackpot is awarded as part of the game outcome determined at 520. If not, the method 500 can return to 504.

If it is determined at 524 that a progressive jackpot was awarded as a game outcome, an indication of the progressive jackpot award can be provided to the EGM from which the wager was received at 528. A reset amount for the progressive jackpot is determined at 532. As will be described in more detail, a reset amount can be zero, can be a fixed amount, or can be an amount that includes an amount provided from escrow. For example, a reset amount can include a base amount, which can be a predetermined, typically fixed, amount (including zero), and an amount from escrow. If the reset amount includes an amount to be applied from escrow, the amount taken from escrow can be subtracted from escrow at 536. The method 500 can then return to 504.

In particular embodiments, disclosed technologies provide for adjusting one or both of an increment rate or an escrow rate. In some cases, both the increment rate and the escrow rate are specifically adjusted, including optionally being independently adjusted. In other cases, one of the increment rate or the escrow rate is determined directly, and the other rate is determined indirectly. For example, if the increment rate is determined directly (e.g., based on one or more game parameters), the escrow rate can be determined indirectly, such as by subtracting the increment rate from a total progressive contribution rate to determine the escrow rate.

Example Techniques for Adjusting Increment and Escrow Rates

Figures 6, 7A, 7B:
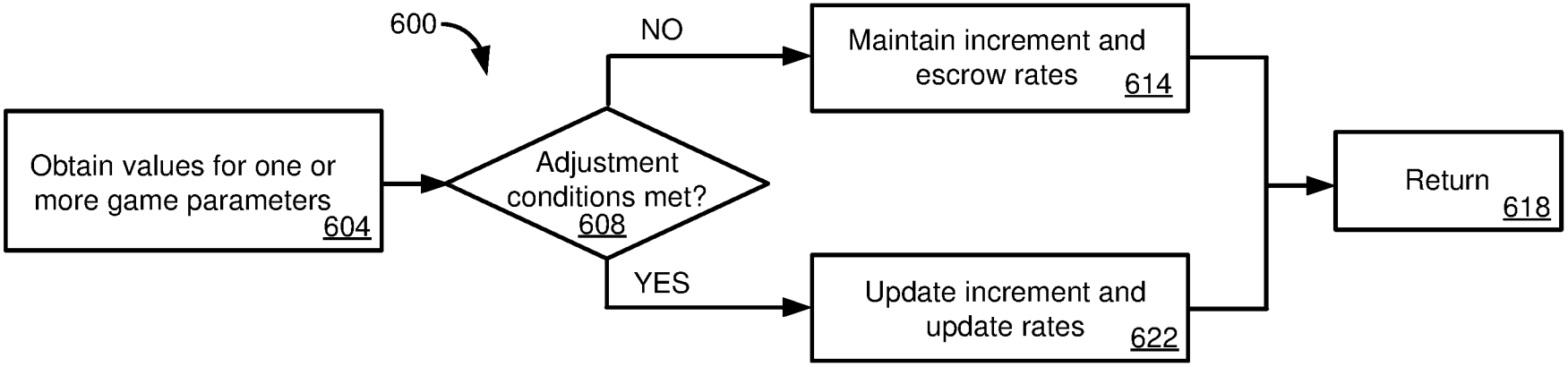
FIG. 6 is a flowchart of an example method for determining when to adjust increment and escrow rates for a progressive jackpot.
FIGS. 7A and 7B are tables illustrating how increment and escrow rates can be determined with respect to values of coin out or games played, respectively.

FIG. 6 is a flowchart of an example method 600 for adjusting increment and escrow rates during game play on an EGM. In some cases, the method 600 is carried out and it can be determined that both the increment rate and the escrow rate should remain unchanged. In other cases, the method 600 is carried out and one or both of the increment rate or the escrow rate are adjusted. The method 600 can be carried out by a progressive system server (e.g., the progressive system server 112 of FIG. 1, or a portion of the game processing backend system 314 of FIG. 3 that provides functionality of a progressive system server), and can represent activities carried out at 508 of FIG. 5.

At 604, values for one or more game parameters are obtained. The game parameters can include game output parameters such as a coin out amount, a handpay amount, a number of games played, a number of EGMs connected to a linked progressive system associated with the jackpot, or a number of EGMs connected to a linked progressive system associated with the jackpot and which are actively being played by players. The game parameters can include other game parameters, including game input parameters such as a coin in amount or a current jackpot value.

Game parameters obtained at 604, and used to determine whether an increment or escrow rate should be adjusted (or a value to which such rates should be set, including maintaining the rates at a particular value) can include single game parameters or multiple game parameters. In particular embodiments, at least one game parameter value obtained at 604 is a game output parameter. The game output parameter can be used in conjunction with one or more other game parameters, including other game output parameters, in setting/evaluating an increment rate or an escrow rate.

It is determined at 608 whether conditions are met for adjusting one or both of an increment rate or an escrow rate. As described, and will be further described in more detail, determining whether adjustment conditions are met at 608 can include comparing a single game parameter, which can be a game output parameter with one or more thresholds. For example, thresholds can be used to define one or more ranges for a game parameter, where each range is associated with a particular increment rate or escrow rate. Or, ranges can be established for combinations of game parameters, including combinations that include at least one game output parameter. Conditions checked at 608 can include determining whether a time or event has occurred.

If it is determined at 608 that adjustment conditions are not met, current increment and escrow rates can be maintained at 614. The method 600 can then end at 618, such as resuming a step in another process (e.g., 524 of FIG. 5). If it is determined at 608 that one or both of the increment rate or the escrow rate should be updated, the rates can be updated at 622, and the method 600 can then continue to 618.

Determining whether adjustment conditions are met at 608 can include evaluating progressive jackpot values for other progressive jackpots. For example, if an EGM includes two progressive jackpots, it may be desirable to have a value of the first progressive jackpot quickly reach a particular level. Once that level is reached, different conditions may apply in determining increment or escrow rates for a second progressive jackpot. For example, an increment rate can be set at a higher level for the first progressive jackpot. Once a threshold value is reached for the first progressive jackpot, a value of the second progressive jackpot can be evaluated. If the value of the second progressive jackpot does not satisfy a threshold, the increment rate for the second progressive jackpot can increase. Once both progressive jackpots have values satisfying their respective thresholds, the increment rate for one or both of the progressive jackpots can decrease, and an escrow rate (which can be for a pooled escrow, described in further detail below, or can be specific to a particular progressive jackpot) can increase.

FIGS. 7A and 7B illustrate two example implementations for adjusting an increment rate and an escrow rate using the process 600. In particular, FIG. 7A provides a table 710 that provides ranges for an increment rate 714 and an escrow rate 716 that are based on ranges of coin out values (a game output parameter) 712. The coin out values 712 thus serve to provide thresholds that determine when a coin out value is sufficiently high to move to a different range, which would result in changing the increment value and escrow rates to those in the correspond row (for the corresponding range) of the table 710.

Note that the increment rate values 714 and the escrow rate values 716 in table 710 are defined such that the sum of the increment rate and the escrow rate always equals a total progressive contribution rate set for the EGM, in this case 4%. Thus, an equivalent table to table 710 could be defined with respect to only coin out values 712 and one of the increment rate 714 or the escrow rate 716, where the other rate is determined by subtracting the specified rate from the total progressive contribution rate specified for the EGM.

FIG. 7B provides another example table 760 that can be used to determine an increment rate 764 or an escrow rate 766 using values 762 for number of games played (a game output parameter). The table 760 is otherwise similar to table 710, including being arranged in a plurality of ranges, and having the sum of the increment rate 764 and the escrow rate 766 consistently equal a fixed total progressive contribution rate of 4% (e.g., 4% of a progressive contribution value).

Note that both tables 710 and 760 illustrate that an escrow rate can be zero. In some cases, criteria that are used to select an increment rate or an escrow rate can be defined such that the escrow rate is never zero. Similarly, criteria can be defined that allow an increment rate to have a value of zero under some conditions. In embodiments where the sum of the increment rate and the escrow rate is always equal to a fixed value, the increment rate and the escrow rate may not both be zero for the same input value (i.e., game parameter). However, in at least some implementations, the increment rate and the escrow rate are not constrained to equal a fixed rate, in which case it is possible to set both the increment rate and the escrow rate to zero for some input criteria.

Figure 8:
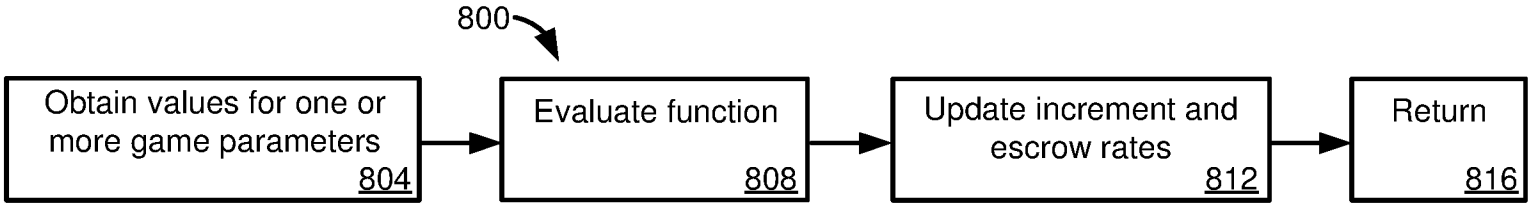
FIG. 8 is a flowchart of a method for determining increment and escrow rates for a progressive jackpot using a function.

Rather than having fixed thresholds that define when or how an increment rate or an escrow rate should change, a function, such as a continuous function, can be used. A method 800 for using a function to determine an increment rate or an escrow rate is shown in FIG. 8. As with the process 600, the process 800 can be carried out by a progressive system server, and can represent activities carried out at 508 of FIG. 5.

At 804, values for one or more game parameters are obtained. 804 can be carried out in analogous manner as operations at 604 of the process 600. A function is evaluated at 808 using one or more parameters obtained at 804. In a particular implementation, at least one parameter used to evaluate the function (e.g., as an input for the function) is a game output parameter. The result of evaluating the function at 808 is one or both of an increment rate or an escrow rate. In some cases, one rate is determined by evaluating the function, and the other rate is determined by subtracting the determined rate for a fixed total progressive contribution rate that has been defined for an EGM (or for a progressive system in communication with one or more EGMs).

The increment rate or escrow rate are adjusted at 812, according to the results of evaluating the function at 808. However, adjusting the rate at 812 can include maintaining a previous rate. That is, for example, the function can produce a given output for multiple input values (or sets of values), such as by rounding a result of the function. The process 800 can end at 816, such as by returning to another process, such as 524 of FIG. 5.

Figure 9:
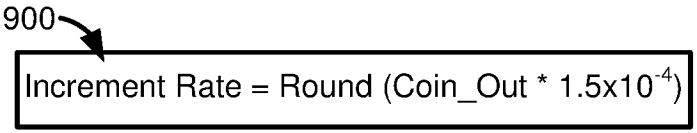
FIG. 9 is an example function that can be used in the method of FIG. 8.

FIG. 9 illustrates an example function 900 that can be used to determine an increment rate based on the input of a coin out value. As can be seen, because the function 900 includes rounding the product of the coin out value and a constant, the function can produce the same output for multiple input values. Although the function 900 uses a single parameter, in this case coin out, functions can use multiple input parameters, and can be based on a sum, product, quotient, or other mathematical combination of input parameters. In addition, a function can add, subtract, or otherwise alter values provided by one or more input parameters (e.g., using the function 900, but adding 1 to the product of coin out and the constant value).

As explained, increment rates or escrow rates can be determined other than using thresholds or functions, such as using a logical expression. The logical expression can be used in a similar manner as thresholds in the method 600 of FIG. 6 (e.g., one or more logical expressions can be evaluated at 608), or the logical expressions can be evaluated in a similar manner as evaluating a function in the method 800 of FIG. 8.

Figure 10:
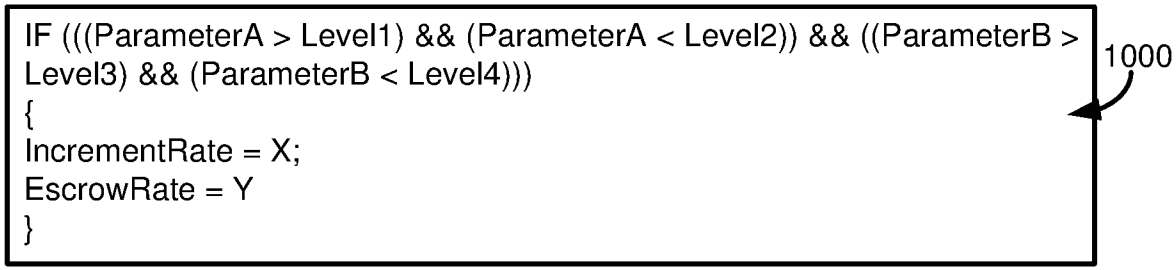
FIG. 10 is example pseudocode for logic that can be used to determine an increment rate and an escrow rate.

FIG. 10 provides an example logical expression 1000. The logical, or conditional, expression 1000 sets an increment rate based on criteria set for both a first game parameter, ParameterA, and a second game parameter, ParameterB. If both logical statements evaluate to true, the increment rate and escrow rate will be updated. Otherwise, the update does not occur. Note that the logical expression 1000 can be one of a series of logical expressions. If a series of logical expressions is provided, statements in the series can be sequentially evaluated. If a logical expression is reached that evaluates to true, specified adjustments to the increment rate or escrow rate can be carried out. If no logical expression in the series is satisfied, a current increment rate or escrow rate can be maintained.

In addition to the specific examples provided for updating an increment rate or an escrow rate based on values for one or more game parameters, disclosed technologies can adjust increment or escrow rates based on other parameters, or using such other parameters in addition to game parameters. These other parameters can be related to a particular day or time, or a particular schedule. These parameters can be used at 508 in the method 500 of FIG. 5.

In some examples, increment or escrow rates can be tied to a specific period of time, which can be set according to a schedule. Examples of time periods can include specifying different rates for morning, afternoon, or evening periods, specifying different rates for weekends as compared with weekdays, specifying different rates for different seasons, or specifying different rates for holiday or special events (e.g., after a concert ends, during a sporting event). In some cases, specific rates can be specified for a given time period. In other cases, the time period can be used to select a particular set of rules or thresholds that will apply during a given time period (e.g., using a first game parameter to determine an increment rate during a morning time period and using a second game parameter to determine an increment rate during an evening time period).

In yet further cases, a time period can be used as a factor in rules or logic (e.g., a function) that determines an increment rate or an escrow rate. For example, the logic can include conditional statements that depend at least in part on a time period or the occurrence or existence of a defined event (e.g., a holiday).

Example Techniques for Applying Escrow to Progressive Jackpot Value

In addition to providing technologies for determining an increment rate or an escrow rate, the present disclosure provides techniques for determining an amount of escrow to apply to one or more jackpots under various conditions. In one aspect, the present disclosure provides for variable amounts of an escrow to be applied to at least one jackpot, where the amount of escrow applied is based at least in part on a current escrow amount.

Figures 11, 12, 13:
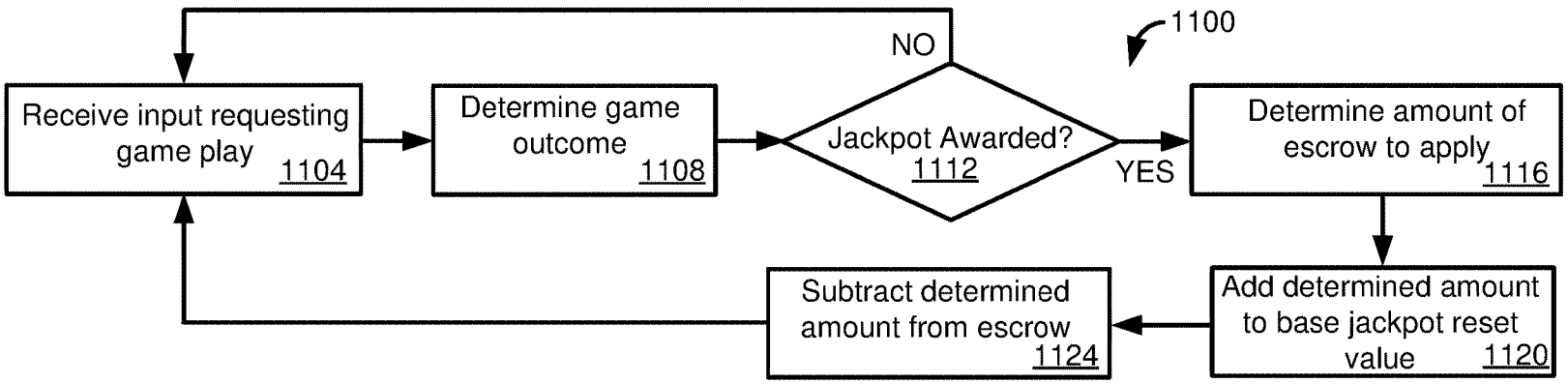
FIG. 11 is a flowchart of a method for determining an amount of escrow to apply to a reset amount of a progressive jackpot.
FIG. 12 is a table illustrating an example of how different amounts of escrow can be applied to a progressive jackpot reset amount based on an escrow amount.
FIG. 13 is example pseudocode that can be used to determine an amount of escrow to apply to a progressive jackpot reset amount.

FIG. 11 illustrates an example method 1100 for determining a portion of escrow to apply to a progressive jackpot based on a current escrow value. The method 1100 can be carried out by a progressive system server, such as the progressive system server 112 of FIG. 1 or a portion of the game processing backend system game processing system 314 of FIG. 3 that provides functionality of a progressive system server.

At 1104, a player provides input requesting game play. For example, the player may place a wager or initiate a game instance using a previously selected (or default) wager amount. A game outcome is determined at 1108, such as using a process corresponding to that described in FIG. 3 (i.e., obtaining a random number from gaming RNG 318 and determining a result using the resulting random number and a lookup table 322A . . . 322N), although it can be carried out by a progressive system server rather than a portion of an EGM that determines a non-progressive jackpot game outcome. For example, a game outcome determined for a given game instance that is associated with a progressive jackpot can include a separate determination of whether a progressive jackpot should be awarded, in particular, using a separate call to the RNG 318 or using through a call to an RNG of the progressive system server 112 of FIG. 1.

At 1112, it is determined where game play results in the award of a progressive jackpot. If not, the method 1110 can return to 1104, awaiting further game play by a player. If it is determined at 1112 that a progressive jackpot is to be awarded as a game outcome, an amount of escrow to be applied to a progressive jackpot reset amount can be determined at 1116.

Typically, a progressive jackpot will have a determined, or base, reset amount. In at least some cases, the base reset amount is a fixed amount set for a progressive jackpot. A base reset amount for a progressive jackpot, or a reset amount overall for the progressive jackpot, can be zero, in some implementations. An amount from escrow can optionally added to a base reset amount to determine the overall reset amount (which can thus vary between times the progressive jackpot is awarded, such based on whether escrow is applied, or an amount of escrow applied to a reset value during a given reset event).

As previously described, players may be more interested in playing an EGM once a progressive jackpot reaches a certain level or range. If an escrow is at least a certain value, some of the value (e.g. monetary value, credits) can be added to the base reset value. Including value from escrow in a reset amount can thus help the progressive jackpot more quickly reach a level at which player interest will be stimulated.

Determining whether an amount in escrow is sufficient to apply to one, or more, progressive jackpots, and an amount to apply, can be implemented in various manners, as will be further described. In a particular example, whether, and an amount, of an escrow value to apply to a jackpot can be based on a current value of the escrow. For example, FIG. 12 illustrates a table 1200 that lists ranges 1210 for escrow amounts, a percentage 1214 of an escrow (i.e., escrow account or pool, which can represent a variable tracked by the EGM, or a progressive system server, such as the progressive system server 112 of FIG. 1, in communication with the EGM) to apply to a progressive jackpot reset value, an example jackpot reset value 1218 with the escrow applied (at the specific threshold level listed), and an example amount remaining in escrow 1222 (at the specific, example escrow value at the given threshold level). The example progressive jackpot reset values 1218 are calculated using a base jackpot reset value of $10,000.

It can be seen from table 1200 that, when an escrow has less value, such as at range 1210*a*, a larger percentage of the escrow can be added to the base jackpot reset value. Applying a larger percentage of a lower escrow amount can help a progressive jackpot reach a desired level more quickly, although less value will remain in escrow afterwards. In the table 1200, the percentage applied from escrow initially decreases as the amount in escrow increases, as shown for ranges 1210*b*, 1210*c*. Applying a lower percentage of a higher escrow amount can help the progressive jackpot reset value reach a desired level, but can leave value in the escrow, which is thus available for other purposes (e.g., applying the escrow towards a future progressive jackpot reset value, once a progressive jackpot is awarded again, or being used to increment a progressive jackpot amount during periods of no, or low, game play activity). Range 1210*d* illustrates that the percentage of escrow 1214 applied to a progressive jackpot reset amount can again increase as escrow value increases.

The percentages of escrow 1214 applied to a progressive jackpot reset value for the ranges 1210 can represent a particular scenario implemented by a game designer. In the scenario, the game designer may wish to apply a larger portion, including all, escrow to a progressive jackpot reset value at low escrow amounts. In this case, the game designer may have decided that funding a progressive jackpot reset value to a particular level is of greater importance than having larger amounts of escrow available for other purposes. As the escrow amount increases, the game designer may decide that having a particular amount of escrow remaining after applying part of the escrow to a progressive jackpot reset amount may be more important than further increasing the progressive jackpot reset value. Once such remaining escrow amounts have reached a desired level, the game designer may decide that additional escrow amounts should be added to the progressive jackpot reset value to further increase player interest.

Of course, the values provided in table 1200 are by way of example only. Thresholds/levels and an accompanying percentage of an escrow to apply to a progressive jackpot reset value can be set at different amounts other than those shown, and a greater or smaller number of levels can be used. In addition, rather than applying a percentage of escrow to a reset value, a given escrow range/threshold can be associated with a fixed amount of escrow to be applied for that level. How escrow amounts/percentages vary according to escrow amount can also be tailored by a game designer as desired, such as having the amount of escrow applied to a progressive jackpot reset value increase by fixed or variable amounts as escrow increases, having the amount of escrow applied decrease by fixed or variable amounts as escrow increases, or having escrow amounts alternatively increase or decrease, but in a different manner than shown in table 1200.

In addition, escrow amounts can be determined other than using the fixed ranges shown in table 1200. FIG. 13 provides example pseudocode 1300 for computing logic to determine an amount of escrow to apply to a jackpot reset value. The pseudocode 1300 can represent instructions implemented in a progressive system server, such as the progressive system server 112 of FIG. 1 or a component of the game processing backend system 314 that provides functionality of a progressive system server. The pseudocode 1300 multiples constant values by game parameters, and has the amount of escrow applied as the sum of the results. In at least some implementation, one of the game parameters used in pseudocode 1300 is a current escrow amount.

Once an amount of escrow to apply to a reset value is determined, it is subtracted from the current escrow value to provide an updated escrow value. Pseudocode 1300 includes logic such that the escrow is not applied to jackpot reset value if the updated escrow amount would be less than zero.

Returning to FIG. 11, after determining at 1116 an amount of escrow to apply to a jackpot reset value, the amount to be applied to escrow is applied to the jackpot reset amount at 1120, and is subtracted from escrow at 1124 to provide an updated escrow amount. The method 1100 can then return to 1104, awaiting further game play.

Example Techniques for Applying Escrow to Multiple Jackpots

Figure 14:
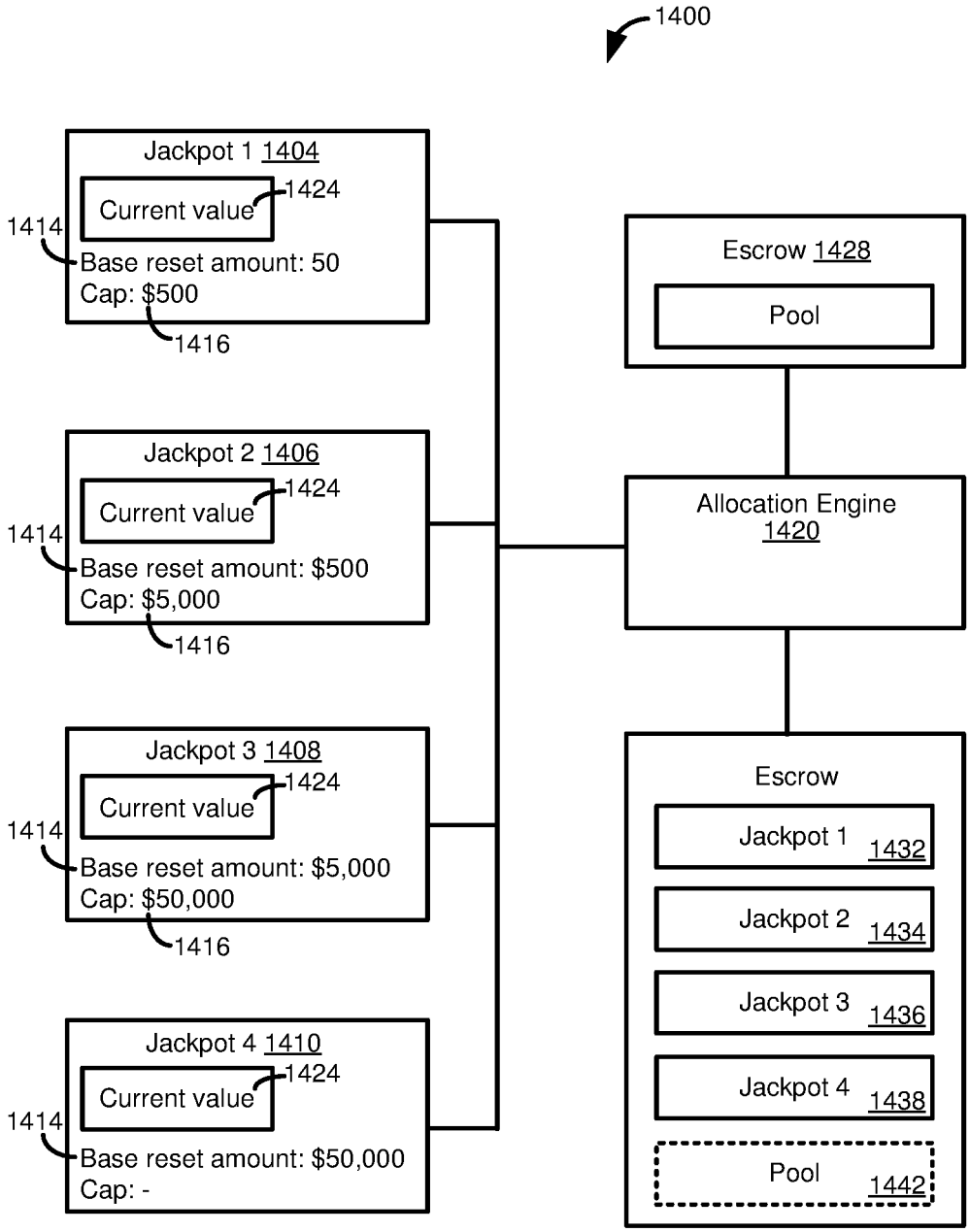
FIG. 14 is a schematic diagram illustrating how multiple jackpots can have portions of progressive contributions allocated by an allocation engine to a pooled escrow or to escrows specific to specific progressive jackpots.

Disclosed technologies provide for applying all or part of an escrow to multiple progressive jackpots. FIG. 14 illustrates a gaming scenario 1400 that includes a plurality of progressive jackpots 1404, 1406, 1408, 1410. The progressive jackpots 1404, 1406, 1408, 1410 can be associated with different levels or tiers, such as described in conjunction with FIG. 4. Each progressive jackpot 1404, 1406, 1408, 1410 is shown as having base reset amount 1414 and, at least for progressive jackpots 1404, 1406, 1408, a cap 1416. In a similar manner as discussed with respect to FIG. 4, although four progressive jackpots are shown, a given EGM can have a single progressive jackpot or can have more or fewer than four progressive jackpots. In addition, an EGM can have one or more non-progressive jackpots in addition to having one or more progressive jackpots.

As described with respect to FIGS. 11-13, a reset amount for a progressive jackpot can include a base reset amount 1414 and an amount applied from escrow. Caps 1416 can be useful when it is desired not to allow a lower-value level progressive jackpot to have a value that exceeds a minimum value for a higher-value progressive jackpot. At least some progressive jackpots can be uncapped, such as progressive jackpot 1410.

An allocation engine 1420 can allocate a progressive contribution associated with game play on EGMs associated with the progressive jackpots 1404, 1406, 1408, 1410 to a current value 1424 of a progressive jackpot, using an increment rate, or to escrow, using an escrow rate. The allocation engine 1420 can be a component of a progressive system sever, such as the progressive system server 112 of FIG. 1 or a component of the game processing backend system 314 of FIG. 3 that provides functionality of a progressive system server.

In one implementation, an allocation engine 1420 allocates portions of progressive contributions associated with qualifying game play on EGMs that are associated with any of the progressive jackpots 1404, 1406, 1408, 1410 to a pooled escrow 1428. Amounts from the pooled escrow 1428 can be applied to any of the progressive jackpots 1404, 1406, 1408, 1410, including applying escrow amounts to multiple of the jackpots, such as when one of the progressive jackpots is awarded.

In another implementation, the allocation engine 1420 allocates a portion of progressive contributions associated with qualifying game play on EGMs associated with the progressive jackpots 1404, 1406, 1408, 1410 to specific escrows associated with a given progressive jackpot. Typically, in this implementation, a portion of a progressive contribution associated with a given progressive jackpot 1404, 1406, 1408, 1410 are allocated to the current value 1424 of that given progressive jackpot or to a respective escrow 1432, 1434, 1436, 1438 for that given progressive jackpot. However, all or a portion of a progressive contribution associated for a given progressive jackpot 1404, 1406, 1408, 1410 can be associated with an escrow rate for a pooled escrow 1442. Typically, progressive contributions that are associated with a jackpot 1406, 1408, 1408, 1410 and subject to an increment rate are applied to a current amount for that progressive jackpot. However, in other implementations, such portions of a progressive contribution may be applied to a different progressive jackpot 1414, 1406, 1408, 1410, or can be applied to multiple progressive jackpots.

When a progressive jackpot 1404, 1406, 1408, 1410 is awarded, at least a portion of its associated escrow 1432, 1434, 1436, 1438 can be added to its base reset amount 1414. Optionally, a portion of any pooled escrow 1442 can be applied to the base reset amount 1414 of the progressive jackpot 1404, 1406, 1408, 1410 that was awarded, or applied to multiple of the progressive jackpots (thus being added to a current value 1424 of a progressive jackpot that was not awarded).

Figure 15:
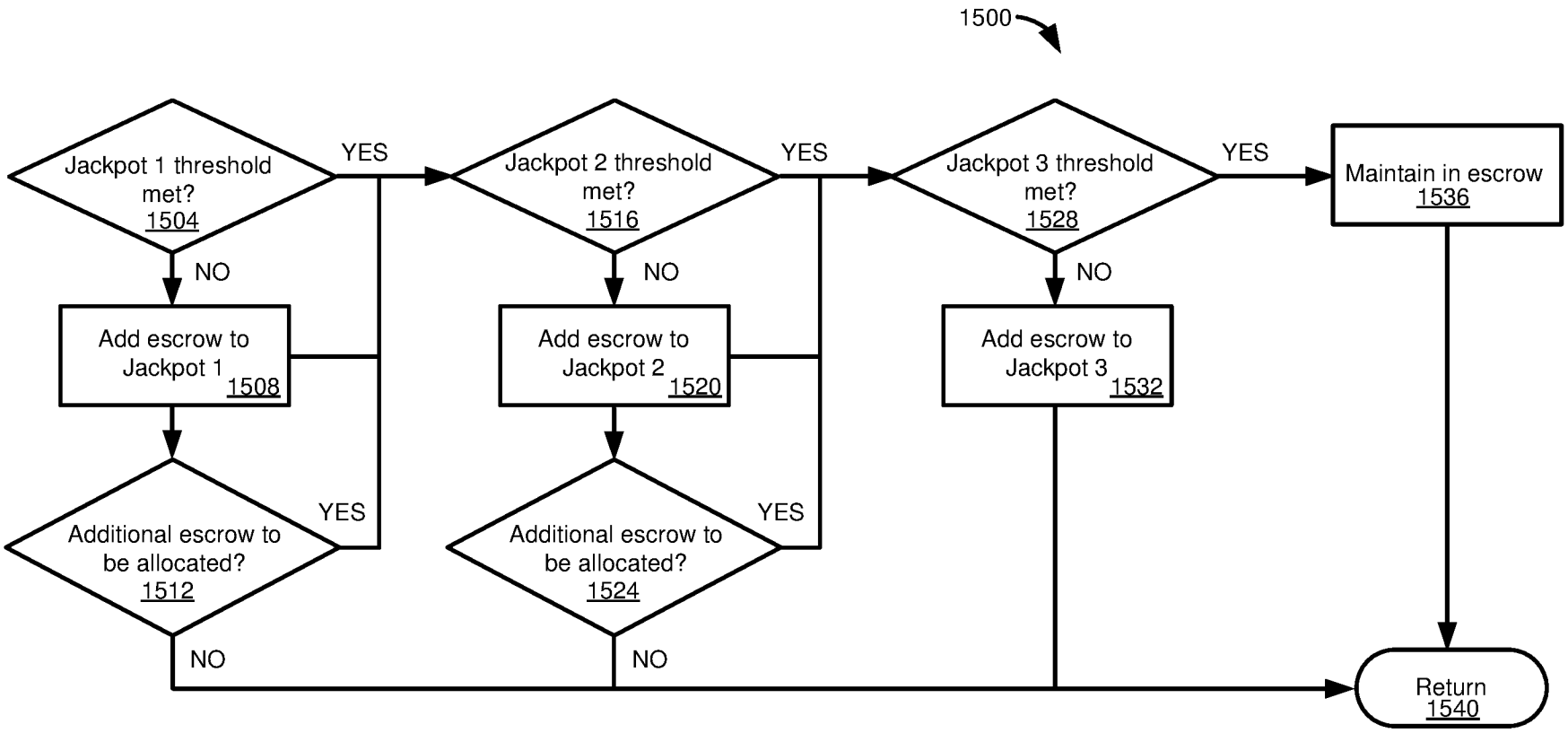
FIG. 15 is a flowchart illustrating a method of applying escrow to multiple progressive jackpots.

FIG. 15 is a flowchart of a method 1500 that illustrates an example technique for allocating at least a portion of a pooled, or shared, escrow to one or more progressive jackpots. In some cases, the method 1500 is carried out when one of the progressive jackpots is awarded. In other cases, the method 1500 can be carried out at other times, such as periodically or in response to the pooled escrow satisfying a particular threshold value. The method 1500 can be carried out by a progressive system server, such as the progressive system server 112 of FIG. 1 or a component of the game processing backend system 314 of FIG. 3 that provides functionality of a progressive system server.

For the purposes of explaining a particular implementation or use of the method 1500, assume that an EGM is associated with three progressive jackpots and that progressive Jackpot 1 has been awarded. The method 1500 thus represents a process for determining a reset amount for progressive Jackpot 1, and determining whether escrow should be applied to current values for progressive Jackpot 2 or progressive Jackpot 3. At 1504, it is determined whether a value threshold for progressive Jackpot 1 is met. In some cases, the value can be zero, or the value can be the base reset value, in which case decision 1504 evaluates to YES, and the method 1500 can proceed to 1516. In other cases, the threshold for progressive Jackpot 1 may have been set higher than zero or a base reset amount. For example, as has been described, a separate target amount may have been determined at which player interest in playing the EGM in a manner (e.g., at a higher wager level) where they might qualify to be awarded progressive Jackpot 1 may increase. In this case, 1504 evaluates to NO, and the method 1500 proceeds to 1508.

At 1508, at least a portion of escrow is included in a reset amount for progressive Jackpot 1, which can be added to a base reset amount. The base reset amount can optionally be zero. The amount of escrow to be applied to the reset amount for progressive Jackpot 1 can be determined in various ways, including as described with respect to FIG. 12 or 13. In some cases, the amount added to a reset amount for progressive Jackpot 1 at 1508 can be an entire value of the escrow.

It is determined at 1512 whether additional escrow should be allocated to other progressive jackpots. Determining whether additional escrow should be allocated to other jackpots can include determining an amount remaining in escrow after 1508. In some cases, as long as escrow remains after 1508, it is applied to other progressive jackpots. In other cases, escrow is not applied to other progressive jackpots unless the amount in escrow satisfies a threshold value (e.g., exceeds or meets a threshold value). 1512 can also include determining whether a rule has been defined allowing escrow to be applied to other progressive jackpots other than the progressive jackpot that was awarded and for which a reset value is being determined.

If it is determined at 1512 that escrow is not to be applied to additional progressive jackpots, the method 1500 can end at 1540 (e.g., returning to 504 or 516 of FIG. 5). Otherwise, the method 1500 proceeds to 1516. At 1516, it is determined whether a current value of progressive Jackpot 2 satisfies a threshold (e.g., a target amount at which game play is expected to increase). If the threshold is satisfied, the method 1500 can proceed to 1528. If not, the method 1500 can proceed to 1520. At 1520 an amount of escrow can be added to the current value of progressive Jackpot 2. The amount of escrow added to the current value of progressive Jackpot 2 can be an entire amount in escrow, or can be an amount sufficient to bring progressive Jackpot 2 to the target amount (or another amount defined for progressive Jackpot 2). It is determined at 1524 whether additional escrow should be allocated, which can be carried out analogously to 1512.

Steps analogous to 1516, 1520 can be carried out for progressive Jackpot 3 at 1528, 1532. However, at 1528, if the threshold for progressive Jackpot 3 is met, any amount remaining in escrow can be maintained in escrow at 1536. After 1532, the method 1500 can continue to 1540.

Various modification to the method 1500 can be made. For example, rather than maintaining remaining value in escrow at 1536, remaining escrow value can be distributed to one or more of the progressive jackpots using other criteria. In particular, the process 1500 can repeated, but different values can be used in determining whether a threshold is met for a progressive jackpot or determining an amount of escrow to apply to a progressive jackpot. That is, one set of rules can be used to try and reach first target levels for each progressive jackpot, and another set of rules can be used to determine how escrow should be applied once the first target level has been reached for each progressive jackpot.

Figure 16:
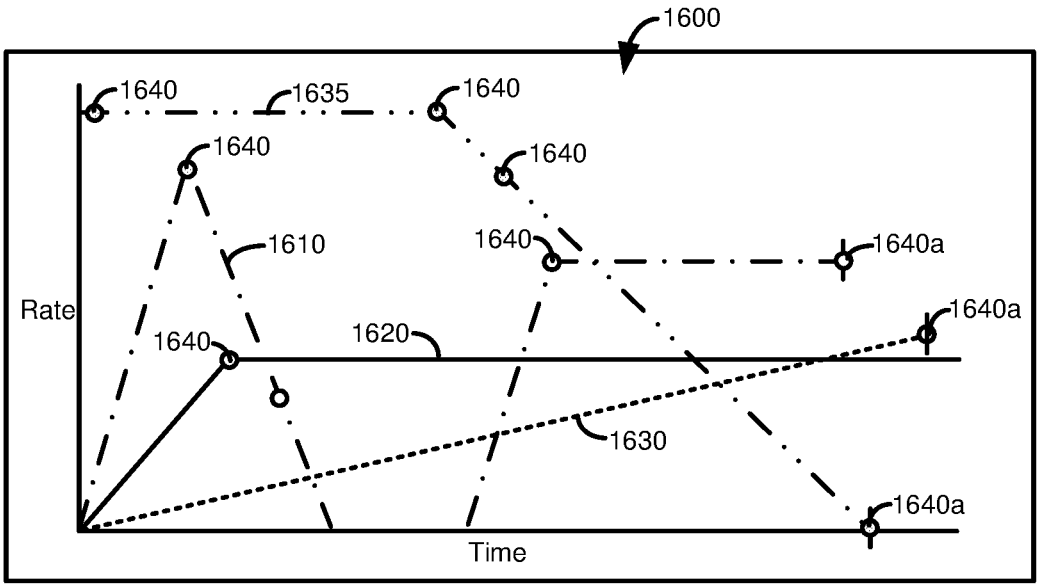
FIG. 16 is an example graph of how an increment rate or an escrow rate can vary over time, and how individual plots can be adjusted, such as based on user input received in association with a user interface screen, to change how a rate changes over time.

Example User Interface Screens Facilitating Progressive Jackpot Configuration The present disclosure also provides tools and techniques that facilitate a game developer or operator in setting various parameters in disclosed technologies, such as determining when and how to vary an increment rate or an escrow rate, or determining how much escrow to apply to one or more jackpots, including upon an award of a jackpot. FIG. 16 presents an example user interface screen 1600 that allows a user to review how a rate (which can be an increment rate or an escrow rate) varies over time.

FIG. 16 presents four alternate scenarios that can be applied. A line 1610 for a first scenario illustrates an initial sharp increase in rate, such as an increment rate, at comparatively early times (e.g., early with respect to initiating overall game play with a particular jackpot, which can be after a jackpot was awarded and a reset value applied) The increment rate then decreases rapidly, stays at zero for a period of time, and then increases sharply before finally plateauing. Scenario 1 can represent a game designer wishing to quickly reach a threshold jackpot value by having a comparatively high increment rate. Once a target value is reached, the game designer may wish to apply a larger portion of a progressive contribution to escrow until escrow has reached a desired level. Once escrow has reached a desired level, the game designer may wish to again increase a proportion of a progressive contribution that is applied to jackpot value by increasing the increment rate.

A line 1620 for a second scenario can represent a game designer applying a consistent increment or escrow rate after an initial rate increase. A line 1630 for a third scenario can represent a game designer applying a consistent increase in the increment or escrow rate over time. A line 1635 represents a fourth scenario, where an increment rate is initially at a high value. Once a desired jackpot level is reached, the increment rate can be reduced, such as having a larger portion of a progressive contribution be applied to escrow.

A user may be permitted to interact with the lines 1610, 1620, 1630 in order to change their shape/characteristics. For example, a user may click and drag one of the connection points 1640 to a desired position, at which point the respective line 1610, 1620, 1630 will be replotted.

Connection points **1640*a* can represent points at which a jackpot value reaches a maximum or capped value. In some cases, after reaching a point 1640*a*, progressive contributions can be allocated to escrow rather than to a progressive jackpot value. Line 1620 is shown without a connection point 1640*a*. Line 1620** can represent a scenario with an uncapped progressive jackpot value. In this scenario, the progressive jackpot value can increase at the selected increment rate until the progressive jackpot is awarded.

Value entered in the screen 1600 (e.g., through adjusting a plot) can be used to set rates used in an actual progressive jackpot used by an EGM. As the user adjusts the lines 1610, 1620, 1630 the rates can be recalculated.

Note that while the screen 1600 has been described in terms of allowing a user to view or set rates over time, the screen 1600 can also be used in an analogous manner to set progressive jackpot value versus time. Once a user has entered a desired change in progressive jackpot value over time, a game processing backend system can calculate appropriate escrow and increment rates to implement a desired scenario, including determining rate levels and when/if/how the rates should change.

Also, while the lines 1610, 1620, 1630, show a single inflection point, increment or escrow rates can be set to increase or decrease multiple times over a given period of time, such as the time between when a progressive jackpot resets and the time the progressive jackpot is awarded. In some cases, increasing a jackpot value (or increment rate) can increase player activity, but the player activity can then drop off after a period of time. After the player activity drops off, the progressive jackpot value or increment rate can again be increased to encourage addition game play. The periods at which increment or escrow rates increase or decrease, or a jackpot value is increased, can be determined in advance, or can be determined dynamically, including by analyzing parameter velocities.

Figure 17:
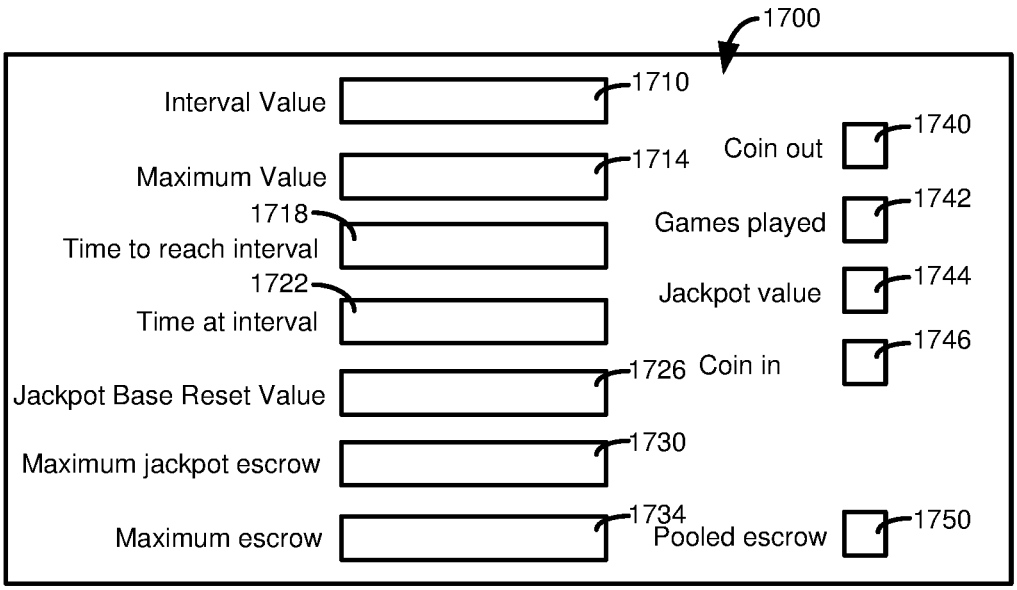
FIG. 17 is an example user interface screen that allows a user to input parameters to be used to determine how increment and escrow rates can vary over time.

FIG. 17 illustrates another user interface screen 1700 that can allow a user to set parameters for a progressive jackpot. Rather than having the lines 1610, 1620, 1630, the screen 1700 includes entry fields for various game parameters. For example, a user can enter a value in a field 1710 that defines a progressive jackpot value that begins an interval at which increased game play is expected. If a progressive jackpot has a maximum value, that value can be provided in a field 1714. A user can enter a desired time to reach the progressive jackpot value provided in field 1710 in a field 1718, and a time that the progressive jackpot should remain in an interval (e.g., between the value in field 1710 and the maximum value of field 1714, or otherwise a time between when the value in field 1710 is reached and when the progressive jackpot is awarded) in a field 1722.

A base jackpot reset value can be specified in a field 1726, and a maximum escrow amount for that jackpot (e.g., a maximum amount of escrow to apply to a reset value) can be entered in a field 1730. In the event a pooled escrow is used for multiple jackpots, the maximum escrow value for the pool can be entered in a field 1734. In some instances, the sum of the jackpot base reset value 1726 and the maximum jackpot escrow 1730 will equal the interval value 1710.

A user can select other options for increment or escrow rates, or for how escrow is to be used, using selection boxes. For example, selection boxes 1740, 1742, 1744, 1746, respectively for coin out, games played, jackpot value, and coin in, allow a user to select one or more game parameters that can be used in determining when/how to adjust an increment or escrow rate. A user can select whether to use a pooled escrow using selection box 1750.

Once a user has entered values, and made appropriate selections, using the user interface screen 1700, application logic can determine how increment rates and escrow rates should be adjusted to accomplish the requested scenario, and to set game parameters, including application of escrow to reset values, accordingly.

Example Time/Event-Based Application of Escrow to Jackpot Value

Typically, escrow is applied to a progressive jackpot value either as part of a reset value or to provide funds for incrementing the progressive jackpot, particularly during periods of relatively low wager activity. However, escrow can be applied to progressive jackpots upon the satisfaction of other criteria, or particular triggers or events. In particular, a game designer or operator may wish to increase a progressive jackpot value upon the occurrence of an event. In at least some cases, adding additional value to a progressive jackpot can further increase player excitement, as well as building player loyalty and possibly reinforcing a positive connection between a player and the event. Examples of events can include regular events, such as holidays, scheduled events, such as concerts or shows, or can include events with an element of unpredictability, such as a sporting event (e.g., it is uncertain what team will win, or what a final score will be).

An amount from escrow added to a progressive jackpot can be permanent or temporary. For example, a progressive jackpot could be increased by $20,000 for a period of two hours after a concert ends or after a sports team wins an event. If a player was awarded a progressive jackpot during that two hours, they would receive the progressive jackpot value as increased with an amount from escrow. If a player did not win the progressive jackpot during the time period, an amount that was added to the progressive jackpot from escrow can be removed from the progressive jackpot and returned to escrow. Typically, while amounts can be transferred between escrow and a progressive jackpot value, all funds are eventually provided to a player in some form, helping maintain a particular return-to-player (RTP) amount set for an EGM, which can be useful in regulatory environments that require a game have a set RTP or otherwise meet RTP requirements.

Amounts to be applied to a progressive jackpot from escrow during game play, as opposed to being part of a reset value, can be determined in various ways. For example, a fixed amount of escrow can be defined to be applied, or a variable amount can be selected, such as selecting to apply a percentage of a current escrow amount. Particularly when a fixed escrow amount is used to increase a progressive jackpot value, increment and escrow rates, and rules for applying escrow in other situations (e.g., as part of a reset value) can be adjusted to ensure that escrow is available to be applied for the event. In some cases, if it is known that a special event is, or may, occur, an escrow rate can be at least temporarily increased, or escrow application rules altered, to maintain a suitable amount in escrow to be applied to the progressive jackpot value. If the event does not occur, the escrow amount can be released for other purposes, and optionally an escrow rate can be reduced.

Figure 18:
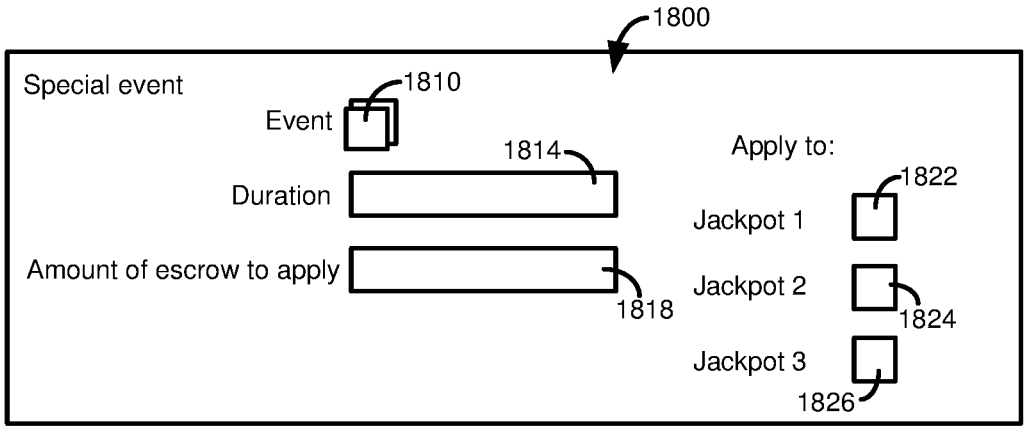
FIG. 18 is an example user interface screen that can allow a user to define how escrow will be applied to a progressive jackpot on the occurrence of event.

FIG. 18 provides an example user interface screen 1800 for entering information related to an event-based trigger for increasing progressive jackpot value. A user can select an event, such as from a calendar, using a user interface control 1810. Optionally, the screen 1800 can provide options for inputting the event, such as entering a start date/time for the event. A user can optionally provide a duration for the progressive jackpot value increase in a field 1814. If a value is entered in the field 1814, and the jackpot has not been awarded during that time, an amount added to the progressive jackpot value from escrow can be returned to escrow.

A user can enter an amount of escrow to apply to the progressive jackpot in a field 1818. The amount of escrow can be a fixed value, or can be a percentage of escrow available at the time the event occurs. A user can select one or more progressive jackpots for which the event-based progressive jackpot value increase will apply using selection boxes 1822, 1824, 1826. In some cases, when multiple progressive jackpots are selected, the criteria defined in the screen 1800 apply to all progressive jackpots, and escrow amounts to be applied to the respective progressive jackpot are taken out of an escrow for that progressive jackpot. In other cases, the escrow for the selected progressive jackpots can be taken from a pooled escrow.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming system comprising:

a first electronic gaming machine configured to present a first wagering game;

a second electronic gaming machine configured to present a second wagering game, the second electronic gaming machine being physically separate from the first electronic gaming machine; and a progressive system server in communication with the first electronic gaming machine and the second electronic gaming machine and comprising computer-executable instructions that, when executed by the progressive system server, cause the progressive system server to perform operations comprising:

for a plurality of game instances played in association with the progressive system server, including game instances played on the first electronic gaming machine and the second electronic gaming machine, tracking one or more game output parameters;

based on the tracking, determining a first value of at least a first game output parameter of the one or more game output parameters for the first electronic gaming machine;

based on the tracking, determining a second value of the at least a first game output parameter for the second electronic gaming machine, wherein the second value is different than the first value;

comparing a third value, the third value determined at least in part using the first value and the second value, with a first threshold defined for the at least a first game output parameter;

determining that the third value does not satisfy the first threshold;

based at least in part on determining that the third value does not satisfy the first threshold, allocating a first portion of a first progressive contribution of a first game instance of the plurality of game instance to a progressive jackpot value associated with the progressive system server at a first percentage and allocating a second portion of the first progressive contribution to an escrow amount at a second percentage, wherein the first and second percentages can be the same and the second percentage can be zero;

based on the tracking, determining a fourth value for at least a second game output parameter of the one or more game output parameters for the first electronic gaming machine, which can be the at least a first game output parameter;

based on the tracking, determining a fifth value for the at least a second game output parameter for the second electronic gaming machine;

comparing a sixth value, the sixth value determined at least in part using the fourth value and the fifth value, with a second threshold defined for the at least a second game output parameter, wherein the second threshold can be the first threshold and wherein the sixth value is greater than the third value when the at least a second game output parameter is the at least a first game output parameter;

determining that the sixth value satisfies the second threshold; and based at least in part on determining that the sixth value satisfies the second threshold, allocating a third portion of a second progressive contribution of a second game instance of the plurality of game instances to the progressive jackpot value at a third percentage and allocating a fourth portion of the second progressive contribution to the escrow amount at a fourth percentage, wherein the third percentage is less than the first percentage and the fourth percentage is greater than the second percentage.

2. The electronic gaming system of claim 1, wherein the first game output parameter is a coin out amount, a hand payout amount, a number of game instances played, a number of electronic gaming machines connected to the progressive system server, and a number of games connected to the progressive system server actively being played by players.

3. The electronic gaming system of claim 1, wherein allocating a first portion of the first progressive contribution to a progressive jackpot value and allocating a second portion of the first progressive contribution to an escrow amount is further based at least in part on a seventh value of a first game parameter tracked by the progressive system server, wherein the first game parameter can be a third game output parameter, where the third game output parameter can be the at least a second game output parameter.

4. The electronic gaming system of claim 3, wherein allocating a third portion of the second progressive contribution to a progressive jackpot value and allocating a fourth portion of the second progressive contribution to an escrow amount is further based at least in part on an eighth value of the first game parameter.

5. The electronic gaming system of claim 1, wherein allocating a third portion of the second progressive contribution to a progressive jackpot value and allocating a fourth portion of the second progressive contribution to an escrow amount is further based at least in part on a seventh value of a first game parameter tracked by the progressive system server, wherein the first game parameter can be a third game output parameter, where the third game output parameter can be the at least a second game output parameter.

6. The electronic gaming system of claim 1, wherein the first threshold is one of a plurality of statically defined thresholds for the at least a first game output parameter.

7. The electronic gaming system of claim 1, wherein the first threshold is determined using a function, wherein the first value serves as at least partial input for the function.

8. The electronic gaming system of claim 7, the operations performed by the progressive system server further comprising:

tracking one or more game play metrics;

determining that the one or more game play metrics fail to satisfy a threshold; and adjusting the function to improve a probability of the one or more game play metrics being satisfied.

9. The electronic gaming system of claim 7, the operations performed by the progressive system server further comprising:

receiving user input defining a target amount range for the progressive jackpot value and a desired duration for the progressive jackpot value to remain in the target amount range; and automatically adjusting the function to reduce a first time needed to reach the target amount range and to increase a second time the progressive jackpot value remains in the target amount range.

10. The electronic gaming system of claim 1, the operations performed by the progressive system server further comprising:

awarding the progressive jackpot value in response to a game outcome of a third game instance of the plurality of game instances;

determining a reset amount for the progressive jackpot value, the reset amount comprising a base reset amount and a fifth percentage of the escrow amount;

setting the reset amount for the progressive jackpot value; and subtracting the reset amount from the escrow amount.

11. The electronic gaming system of claim 10, wherein the fifth percentage is determined based at least in part on a current value of the escrow amount.

12. The electronic gaming system of claim 11, wherein a plurality of escrow amount thresholds are defined, a given escrow amount threshold being based at least in part on an escrow amount.

13. The electronic gaming system of claim 10, wherein the progressive jackpot value is for a first progressive jackpot of a plurality of progressive jackpots, the plurality of progressive jackpots being arranged in a plurality of tiered levels by progressive jackpot value and the escrow amount is shared between the tiered levels.

14. The electronic gaming system of claim 10, wherein the progressive jackpot value is for a first progressive jackpot of a plurality of progressive jackpots, the plurality of progressive jackpots being arranged in a plurality of tiered levels by progressive jackpot value and the first percentage is based at least in part on a current value of the first progressive jackpot, and wherein:

the first percentage is set to a higher value when the current value fails to satisfy a threshold and a lower value when the current value satisfies the threshold; and when the current value satisfies the threshold, increasing a jackpot increment rate for a second progressive jackpot of the plurality of progressive jackpots.

15. The electronic gaming system of claim 10, wherein the progressive jackpot value is for a first progressive jackpot of a plurality of progressive jackpots, the plurality of progressive jackpots being arranged in a plurality of tiered levels by progressive jackpot value and the escrow amount is only available for use with the first progressive jackpot.

16. The electronic gaming system of claim 1, wherein the progressive jackpot value is for a first progressive jackpot of a plurality of progressive jackpots, the plurality of progressive jackpots being arranged in a plurality of tiered levels by progressive jackpot value, and the operations performed by the progressive system server further comprise:

awarding the first progressive jackpot in response to a game outcome of the plurality of game instances;

determining a target reset amount for the first progressive jackpot;

determining that a sum of a base reset amount and the escrow amount exceeds the target reset amount;

applying a first amount of the escrow amount to a reset amount for the first progressive jackpot;

subtracting the first amount from the escrow amount; and applying at least a portion of a remaining amount of the escrow amount to a second progressive jackpot of the plurality of progressive jackpots.

17. The electronic gaming system of claim 1, the operations performed by the progressive system server further comprising:

awarding the progressive jackpot value in response to a game outcome of a third game instance of the plurality of game instances;

determining a reset amount for the progressive jackpot value, the determining the reset amount comprising:

determining a first percentage of the escrow amount;

determining a sum of the first percentage of the escrow amount and a base reset amount;

comparing the sum with a reset amount threshold;

determining that the sum satisfies the reset amount threshold;

in response to determining that the sum satisfies the reset amount threshold, reducing the reset amount to a reduced reset amount that is under the reset amount threshold;

setting the reset amount for the progressive jackpot value as the reduced reset amount; and subtracting an amount of the reduced reset amount attributable to the escrow amount from the escrow amount.

18. An electronic gaming system comprising:

a first electronic gaming machine configured to present a first wagering game;

a second electronic gaming machine configured to present a second wagering game, the second wagering game being different from the first wagering game; and a progressive system server in communication with the first electronic gaming machine and the second electronic gaming machine and comprising computer-executable instructions that, when executed by the progressive system server, cause the progressive system server to perform operations comprising:

for a plurality of game instances played in association with the progressive system server, including game instances played on the first electronic gaming machine and the second electronic gaming machine, tracking one or more game output parameters;

based on the tracking, determining a first value of at least a first game output parameter of the one or more game output parameters for the first wagering game;

comparing the first value with a first threshold defined for the at least a first game output parameter;

determining that the first value does not satisfy the first threshold;

based at least in part on determining that the first value does not satisfy the first threshold, allocating a first portion of a first progressive contribution of a first game instance of the plurality of game instance to a progressive jackpot value associated with the progressive system server at a first percentage and allocating a second portion of the first progressive contribution to an escrow amount at a second percentage, wherein the first and second percentages can be the same and the second percentage can be zero;

based on the tracking, determining a second value for at least a second game output parameter for the second wagering game, the second value being greater than the first value when the at least a second game output parameter is the at least a first game output parameter;

comparing the second value with a second threshold defined for the at least a second game output parameter, wherein the second threshold can be the first threshold;

determining that the second value satisfies the second threshold; and based at least in part on determining that the second value satisfies the second threshold, allocating a third portion of a second progressive contribution of a second game instance of the plurality of game instances to the progressive jackpot value at a third percentage and allocating a fourth portion of the second progressive contribution to the escrow amount at a fourth percentage, wherein the third percentage is less than the first percentage and the fourth percentage is greater than the second percentage.

19. An electronic gaming system comprising:

a first electronic gaming machine configured to present a first wagering game;

a second electronic gaming machine configured to present a second wagering game, the second wagering game having a different volatility than the first wagering game; and a progressive system server in communication with the first electronic gaming machine and the second electronic gaming machine and comprising computer-executable instructions that, when executed by the progressive system server, cause the progressive system server to perform operations comprising:

for a plurality of game instances played in association with the progressive system server, including game instances played on the first electronic gaming machine and the second electronic gaming machine, tracking one or more game output parameters;

based on the tracking, determining a first value of a first game output parameter of the one or more game output parameters;

comparing the first value with a first threshold defined for the first game output parameter;

determining that the first value does not satisfy the first threshold;

based at least in part on determining that the first value does not satisfy the first threshold, allocating a first portion of a first progressive contribution of a first game instance of the plurality of game instances to a progressive jackpot value associated with the progressive system server at a first percentage and allocating a second portion of the first progressive contribution to a pooled escrow amount at a second percentage, wherein the first and second percentages can be the same and the second percentage can be zero, wherein the first game instance is an instance of the first wagering game;

based on the tracking, determining a second value for a second game output parameter, which can be the first game output parameter, the second value being greater than the first value when the second game output parameter is the first game output parameter;

comparing the second value with a second threshold defined for the second game output parameter, wherein the second threshold can be the first threshold;

determining that the second value satisfies the second threshold; and based at least in part on determining that the second value satisfies the second threshold, allocating a third portion of a second progressive contribution of a second game instance of the plurality of game instances to the progressive jackpot value at a third percentage and allocating a fourth portion of the second progressive contribution to the pooled escrow amount at a fourth percentage, wherein the third percentage is less than the first percentage and the fourth percentage is greater than the second percentage, wherein the second game instance is an instance of the second wagering game.

20. The electronic gaming system of claim 19, wherein the first progressive contribution is equal to a sum of the first portion of the first progressive contribution and the second portion of the first progressive contribution; and wherein the second progressive contribution is equal to a sum of the third portion of the second progressive contribution and the fourth portion of the second progressive contribution.

* * * * *